US012473625B2

(12) United States Patent
Tokuda et al.

(10) Patent No.: US 12,473,625 B2
(45) Date of Patent: Nov. 18, 2025

(54) HOT-DIP PLATED STEEL SHEET

(71) Applicant: NIPPON STEEL CORPORATION, Tokyo (JP)

(72) Inventors: Kohei Tokuda, Tokyo (JP); Mamoru Saito, Tokyo (JP); Yuto Fukuda, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

(21) Appl. No.: 18/839,238

(22) PCT Filed: Feb. 21, 2023

(86) PCT No.: PCT/JP2023/006105
§ 371 (c)(1),
(2) Date: Aug. 16, 2024

(87) PCT Pub. No.: WO2023/157973
PCT Pub. Date: Aug. 24, 2023

(65) Prior Publication Data

US 2025/0109477 A1 Apr. 3, 2025

(30) Foreign Application Priority Data

Feb. 21, 2022 (JP) ..... 2022-024939

(51) Int. Cl.

| | |
|---|---|
| ***C22C 18/04*** | (2006.01) |
| ***B32B 15/01*** | (2006.01) |
| ***C21D 9/46*** | (2006.01) |
| ***C22C 21/06*** | (2006.01) |
| ***C23C 2/06*** | (2006.01) |
| ***C23C 2/12*** | (2006.01) |
| ***C23C 2/40*** | (2006.01) |

(52) U.S. Cl.
CPC ..... *C23C 2/40* (2013.01); *C21D 9/46* (2013.01); *C22C 21/06* (2013.01); *C23C 2/12* (2013.01)

(58) Field of Classification Search
None
See application file for complete search history.

(56) References Cited

U.S. PATENT DOCUMENTS

| | | | |
|---|---|---|---|
| 2019/0390303 | A1 | 12/2019 | Tokuda et al. |
| 2020/0002798 | A1 | 1/2020 | Tokuda et al. |
| 2022/0145425 | A1 | 5/2022 | Mitsunobu et al. |
| 2022/0356547 | A1 | 11/2022 | Tokuda et al. |

FOREIGN PATENT DOCUMENTS

| | | | |
|---|---|---|---|
| WO | WO 2018/139619 | A1 | 8/2018 |
| WO | WO 2018/139620 | A1 | 8/2018 |
| WO | WO 2019/221193 | A1 | 11/2019 |
| WO | WO 2020/213686 | A1 | 10/2020 |
| WO | WO 2020/261723 | A1 | 12/2020 |

OTHER PUBLICATIONS

Honda et al., "Influence of Si Addition to the Coating Bath on the Growth of Al—Fe Alloy Layers in Hot-dip Zn—Al—Mg Alloy-coated Steel Sheets", Tetsu-to-Hagane, 2011, vol. 97, No. 1, pp. 19-25, https://doi.org/10.2355/tetsutohagane.97.19.

Mendala, "The influence of Si addition in 55AlZn bath on the coating structures obtained in the batch hot-dip metallization", IOP Conference Series: Materials Science and Engineering, 2011, vol. 22, pp. 1-7, doi:10.1088/1757-899X/22/1/012005.

*Primary Examiner* — Anthony M Liang
(74) *Attorney, Agent, or Firm* — Birch, Stewart, Kolasch & Birch, LLP

(57) ABSTRACT

A hot-dip plated steel sheet has a plating layer, in which the plating layer contains Al: more than 30.0% and 50.0% or less, Mg: more than 5.0% and 15.0% or less, Si: more than 0.5% and 1.0% or less when Al is more than 30.0% and less than 35.0%, and 0.03% or more and 1.0% or less when Al is 35.0% or more and 50.0% or less, Fe: 0% or more and 5.0% or less, and a remainder consisting of Zn and impurities, and, in an X-ray diffraction pattern of a surface of the plating layer, $I_1$ obtained from X-ray diffraction peaks of Zn, Al, and $MgZn_2$ is 0.10 or less and $I_2$ obtained from an X-ray diffraction peak of $Al_2O_5Si$ is 1.05 or more.

2 Claims, 1 Drawing Sheet

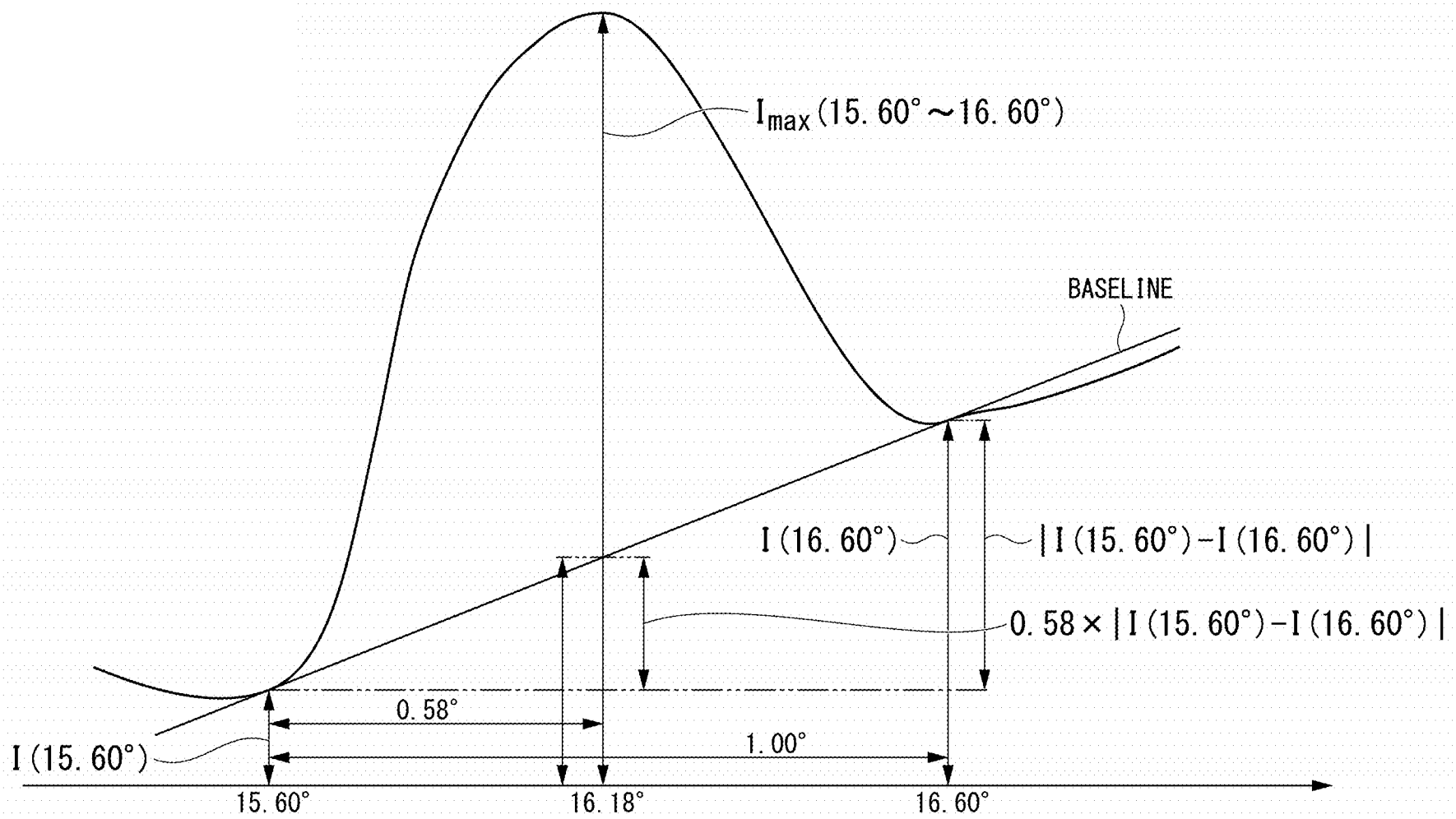
$I_{max}$(15. 60°～16. 60°)
BASELINE
|I(15. 60°)−I(16. 60°)|
0. 58×|I(15. 60°)−I(16. 60°)|
I(16. 60°)
1. 00°
0. 58°
16. 60°
16. 18°
15. 60°
I(15. 60°)

HOT-DIP PLATED STEEL SHEET

TECHNICAL FIELD OF THE INVENTION

The present invention relates to a hot-dip plated steel sheet.

The present application claims priority based on Japanese Patent Application No. 2022-024939 filed in Japan on Feb. 21, 2022, the contents of which are incorporated herein by reference.

BACKGROUND ART

A plated steel material is classified into a post-plating product and a pre-plating product depending on a difference in manufacturing method. The post-plating product is manufactured by a method in which a steel sheet is processed into a steel material having a predetermined shape, and then the steel material is immersed in a hot-dip galvanizing bath (post-galvanized method). On the other hand, the pre-plating product is manufactured by continuously immersing a steel sheet in a hot-dip plating bath to form a hot-dip plated steel sheet, and then processing the hot-dip plated steel sheet into a predetermined shape. In JIS H 8641:2007 defines the type, symbol, plating quality, external appearance, and adhesion amount for the post-plating product. For example, the adhesion amount of plating of the symbol HDZ35 is defined as 350 g/m$^2$ or more, and the deposition amount of plating of the symbol HDZ55 is defined as 550 g/m$^2$ or more.

Such a plated steel material is used in various applications, and is particularly used in water as a severe corrosive environment. As a use application of such a plated steel material, for example, a water passage formed of steel, a water collection trough, and the like are assumed. According to "Regarding galvanizing" on the homepage of Japan Galvanizers Association Inc., a corrosion rate of zinc in water reaches 30 to 100 g/m$^2$. This means that even a post-plating product corresponding to the symbol HDZ35 to HDZ55 having a relatively large plating thickness ends a lifetime of a plating layer in three to five years at the earliest.

Therefore, in an application in an underwater environment or an application where water wetting may occur, the thickness of plating needs to be large, and for such an application, a post-plating product manufactured by a post-galvanized method is often used. On the other hand, the pre-plating product is made of a hot-dip galvanized steel sheet or a zinc alloy-plated steel sheet manufactured by a steel manufacturer. However, since the plating thickness of each of these plated steel sheets is about less than ⅓ of the plating thickness of the post-plating product, the pre-plating product is extremely disadvantageous in terms of durable years in an underwater environment or an environment in which water wetting occurs.

The present inventors have studied application of the pre-plating product as a plated steel material used in an underwater environment or an environment in which water wetting occurs. For example, a Zn-based plated steel sheet as described in Patent Documents 1 to 3 has been developed. As a result, corrosion resistance can also be ensured in water and in water wetting applications, but there is room for further improvement. If corrosion resistance in water or under an environment in which wetting with water occurs can be further improved, the pre-plating product can be expected to be widely adopted as a plated steel material used in ponds, rivers, coasts, and the like.

CITATION LIST

Patent Document

Patent Document 1: PCT International Publication No. WO 2018/139619

Patent Document 2: PCT International Publication No. WO 2018/139620

Patent Document 3: PCT International Publication No. WO 2019/221193

SUMMARY OF INVENTION

Problems to be Solved by the Invention

The present invention has been made in view of the above circumstances, and an object of the present invention is to provide a hot-dip plated steel sheet capable of exhibiting high corrosion resistance in water or under a constant water wetted environment in which water wetting may occur.

Means for Solving the Problem

In order to solve the above problem, the present invention adopts the following configurations.

[1] A hot-dip plated steel sheet having a plating layer on a surface of a steel sheet, in which the plating layer has an average chemical composition including, in mass %, Al: more than 30.0% and 50.0% or less, Mg: more than 5.0% and 15.0% or less, Sn: 0% or more and 0.70% or less, Bi: 0% or more and 0.30% or less, In: 0% or more and 0.30% or less, Ca: 0.03% or more and 0.60% or less, Y: 0% or more and 0.30% or less, La: 0% or more and 0.30% or less, Ce: 0% or more and 0.30% or less, Si: more than 0.5% and 1.0% or less when Al is more than 30.0% and less than 35.0%, and 0.03% or more and 1.0% or less when Al is 35.0% or more and 50.0% or less, Cr: 0% or more and 0.25% or less, Ti: 0% or more and 0.25% or less, Ni: 0% or more and 1.0% or less, Co: 0% or more and 0.25% or less, V: 0% or more and 0.25% or less, Nb: 0% or more and 0.25% or less, Cu: 0% or more and 0.25% or less, Mn: 0% or more and 0.25% or less, Fe: 0% or more and 5.0% or less, Sr: 0% or more and 0.5% or less, Sb: 0% or more and 0.5% or less, Pb: 0% or more and 0.5% or less, B: 0% or more and 0.5% or less, Li: 0% or more and 0.5% or less, Zr: 0% or more and 0.5% or less, Mo: 0% or more and 0.5% or less, W: 0% or more and 0.5% or less, Ag: 0% or more and 0.5% or less, P: 0% or more and 0.5% or less, and a remainder consisting of Zn and impurities, the total amount ΣA of Sn, Bi, and In is 0% or more and 0.70% or less, the total amount ΣB of Ca, Y, La, and Ce is 0.03% or more and 0.60% or less, the total amount ΣC of Cr, Ti, Ni, Co, V, Nb, Cu, and Mn is 0% or more and 1.00% or less, the total amount ΣD of Sr, Sb, Pb, B, Li, Zr, Mo, W, Ag, and P is 0% or more and 0.5% or less, the following formulas (1) to (3) are satisfied, in an X-ray diffraction pattern of a surface of the plating layer, measured under conditions in which an X-ray output is a voltage of 50 kV and a current of 300 mA using a Cu—Kα ray, when $I_1$ obtained from X-ray diffraction peaks of Zn, Al, and $MgZn_2$ is defined by formula (A-1), formula (A-2) is satisfied, and when $I_2$ obtained from an X-ray diffraction peak of $Al_2O_5Si$ is defined by formula (B-1), formula (B-2) is satisfied.

$$Sn \leq Si \quad (1)$$

$$15 \leq Mg/Si \quad (2)$$

$$1.0 \leq Si/Ca \leq 5.0 \quad (3)$$

[Mathematical Formula 1]

$$I_1 = \frac{I\max(36.00\sim36.60^\circ)}{I\max(36.00\sim36.60^\circ) + I\max(38.00\sim39.00^\circ) + I\max(19.20\sim20.00^\circ)} \quad (A-1)$$

$$I_1 \leqq 0.10 \quad (A-2)$$

$$I_2 = \frac{I\max(15.60\sim16.60^\circ)}{I(15.60^\circ) + 0.58\{|I(15.60^\circ) - I(16.60^\circ)|\}} \quad (B-1)$$

$$1.05 \leqq I_2 \quad (B-2)$$

Provided that, in formulas (1) to (3), Sn, Si, Mg, and Ca represent the contents (mass %) of the respective elements in the plating layer, Imax (k to m°) in formulas (A-1) and (B-1) represents an absolute maximum value of an X-ray diffraction intensity between a diffraction angle of k° and a diffraction angle of m°, Imax (n°) represents an X-ray diffraction intensity at a diffraction angle of n°, and k, m, and n each represent a diffraction angle indicated in formulas (A-1) and (B-1).

[2] The hot-dip plated steel sheet according to [1], in which in an X-ray diffraction pattern of a surface of the plating layer, measured under conditions in which an X-ray output is a voltage of 50 kV and a current of 300 mA using a Cu—Kα ray, when $I_3$ obtained from an X-ray diffraction peak of $MgZn_2$ is defined by formula (C-1), formula (C-2) is satisfied.

[Mathematical Formula 2]

$$I_3 = \frac{I\max(28.52\sim28.92^\circ)}{\{I\max(19.20\sim20.00^\circ) + I\max(20.58\sim20.98^\circ) + I\max(22.06\sim22.46^\circ) + I\max(28.52\sim28.92^\circ)\}} \quad (C-1)$$

$$I_3 \leqq 0.03 \quad (C-2)$$

Provided that Imax (k to m°) in formula (C-1) represents an absolute maximum value of an X-ray diffraction intensity between a diffraction angle of k° and a diffraction angle of m°, and k and m each represent a diffraction angle indicated in formula (C-1).

Effects of the Invention

The present invention can provide a hot-dip plated steel sheet capable of exhibiting high corrosion resistance in water (in simulated acid rain or salt water such as seawater) or under a constant water wetted environment in which water wetting may occur. Note that, in the following description, "in simulated acid rain" may be referred to as in water having a relatively low salt concentration, and "seawater (salt water)" may be referred to as in water having a relatively high salt concentration.

BRIEF DESCRIPTION OF THE DRAWINGS

FIG. 1 is a schematic diagram for explaining formula (B-1).

EMBODIMENT OF THE INVENTION

The present inventors have intensively studied a hot-dip plated steel sheet including a plating layer containing Al, Mg, and Zn and manufactured by a continuous hot-dip galvanizing method in order to improve corrosion resistance under a constant water wetted environment.

When Zn is contained in the plating layer, a Zn phase may be formed in a microstructure of the plating layer. Since the Zn phase is likely to be corroded in water and the corrosion proceeds until the Zn phase disappears, the Zn phase should not be used as a main phase of the plating layer. Various intermetallic compound phases are observed in a plating layer containing Al, Mg, and Zn, and in the present invention, the chemical composition thereof is adjusted, and particularly the amount of Al is increased in order to limit the phase amount of the Zn phase.

When the amount of Al is increased, a large amount of Al phase is formed in a microstructure of the plating layer. In water having a relatively low salt concentration, such as soft water, hard water, or acid rain, the Al phase is excellent in corrosion resistance, and therefore Al may be contained. A reason why the Al phase is excellent in water resistance is considered to be that an alumina coating such as $Al_2O_3$ is formed on a surface of Al. Note that, when the amount of Al is low, the effect of this coating is not sufficient, and therefore it is necessary to cover the surface with an oxide stable in water. For this, it is useful to add Si which is similarly stable as an oxide to the plating layer, and corrosion resistance in water can be ensured by inclusion of an Al—Si—O-based compound.

On the other hand, in seawater or the like containing salt, Al is easily corroded, and therefore the content of Al has to be limited. In order to improve corrosion resistance to salt water while keeping the large amount of Al, it is preferable to increase a ratio of a substance having a complicated crystal structure, such as an intermetallic compound, and for example, a large amount of $MgZn_2$ phase is preferably contained. Note that, in a case where the plating layer contains a large amount of $MgZn_2$ phase, it is necessary to reduce the amount of $MgZn_2$ phase having a specific plane orientation as contained in a ternary eutectic structure and to largely grow $MgZn_2$ phase having coarse grains. This is because most of the $MgZn_2$ phase present in a ternary eutectic together with a Zn phase, an Al phase, and the like is likely to corrode. A reason for this is considered to be that coupling reaction due to a surrounding microstructure is active and a specific orientation of the $MgZn_2$ phase is present in the ternary eutectic structure. By limiting the amount of $MgZn_2$ phase having a specific plane orientation as contained in the ternary eutectic structure, extremely high corrosion resistance can be exhibited even in salt water.

On the other hand, when a large amount of Al is contained in a plating bath containing Al, Mg, and Zn, iron contained in a steel sheet reacts with Al in the plating bath when the steel sheet is immersed in the plating bath to generate an Fe—Al-based compound, and this Fe—Al-based compound serving as an interface alloy layer is formed between a plating layer and the steel sheet. When the interface alloy layer is formed thick, the plating layer is relatively thin, and sufficient corrosion resistance cannot be obtained. In addition, adhesion of the plating layer is deteriorated. Therefore, in order to manufacture the hot-dip plated steel sheet according to the present invention, it is necessary to prevent formation of the interface alloy layer as much as possible.

Hereinafter, a plated steel sheet according to an embodiment of the present invention will be described.

A hot-dip plated steel sheet according to the embodiment of the present invention is a hot-dip plated steel sheet having a plating layer on a surface of a steel sheet, in which the plating layer has an average chemical composition including, in mass %, Al: more than 30.0% and 50.0% or less, Mg: more than 5.0% and 15.0% or less, Sn: 0% or more and 0.70% or less, Bi: 0% or more and 0.3% or less, In: 0% or more and 0.3% or less, Ca: 0.03% or more and 0.60% or less, Y: 0% or more and 0.3% or less, La: 0% or more and 0.3% or less, Ce: 0% or more and 0.3% or less, Si: more than 0.5% and 1.0% or less when Al is more than 30.0% and less than 35.0%, and 0.03% or more and 1.0% or less when Al is 35.0% or more and less than 50.0%, Cr: 0% or more and 0.25% or less, Ti: 0% or more and 0.25% or less, Ni: 0% or more and 1.0% or less, Co: 0% or more and 0.25% or less, V: 0% or more and 0.25% or less, Nb: 0% or more and 0.25% or less, Cu: 0% or more and 0.25% or less, Mn: 0% or more and 0.25% or less, Fe: 0% or more and 5.0% or less, Sr: 0% or more and 0.5% or less, Sb: 0% or more and 0.5% or less, Pb: 0% or more and 0.5% or less, B: 0% or more and 0.5% or less, Li: 0% or more and 0.5% or less, Zr: 0% or more and 0.5% or less, Mo: 0% or more and 0.5% or less, W: 0% or more and 0.5% or less, Ag: 0% or more and 0.5% or less, P: 0% or more and 0.5% or less, and Zn and impurities as a remainder, the total amount ΣA of Sn, Bi, and In is 0% or more and 0.70% or less, the total amount ΣB of Ca, Y, La, and Ce is 0.03% or more and 0.60% or less, the total amount ΣC of Cr, Ti, Ni, Co, V, Nb, Cu, and Mn is 0% or more and 1.00% or less, the total amount ΣD of Sr, Sb, Pb, B, Li, Zr, Mo, W, Ag, and P is 0% or more and 0.5% or less, the following formulas (1) to (3) are satisfied, in an X-ray diffraction pattern of a surface of the plating layer, measured under conditions in which an X-ray output is a voltage of 50 kV and a current of 300 mA using a Cu—Kα ray, when $I_1$ obtained from X-ray diffraction peaks of Zn, Al, and $MgZn_2$ is defined by formula (A-1), formula (A-2) is satisfied, and when $I_2$ obtained from an X-ray diffraction peak of $Al_2O_5Si$ is defined by formula (B-1), formula (B-2) is satisfied.

[Mathematical Formula 3]

$$Sn \leqq \mathrm{Si} \tag{1}$$

$$15 \leqq \mathrm{Mg/Si} \tag{2}$$

$$1 \leqq \mathrm{Si/Ca} \leqq 5.0 \tag{3}$$

$$\mathrm{I}_1 = \frac{\mathrm{Imax}(36.00\sim36.60^\circ)}{\mathrm{Imax}(36.00\sim36.60^\circ) + \mathrm{Imax}(38.00\sim39.00^\circ) + \mathrm{Imax}(19.20\sim20.00^\circ)} \tag{A-1}$$

$$I_1 \leqq 0.10 \tag{A-2}$$

-continued $$I_2 = \frac{I\mathrm{max}(15.60\sim16.60^\circ)}{I(15.60^\circ) + 0.58\{|I(15.60^\circ) - I(16.60^\circ)|\}} \tag{B-1}$$

$$1.05 \leqq I_2 \tag{B-2}$$

Note that, in formulas (1) to (3), Sn, Si, Mg, and Ca represent the contents (mass %) of the respective elements in the plating layer, Imax (k to m°) in formulas (A-1) and (B-1) represents an absolute maximum value of an X-ray diffraction intensity between a diffraction angle of k° and a diffraction angle of m°, Imax (n°) represents an X-ray diffraction intensity at a diffraction angle of n°, and k, m, and n each represent a diffraction angle indicated in formulas (A-1) and (B-1).

Note that in the following description, the expression "%" of the content of each element in a chemical composition means "mass %". In addition, a numerical range represented by "to" means a range including numerical values described before and after "to" as a lower limit and an upper limit. In addition, a numerical range in which "more than" or "less than" is attached to numerical values described before and after "to" means a range not including these numerical values as a lower limit or an upper limit.

The "corrosion resistance" indicates a property that a plating layer itself is hardly corroded. A Zn-based plating layer has a sacrificial corrosion protection action on a steel material. Therefore, in a corrosion process of a plated steel sheet, the Zn-based plating layer corrodes and turns into white rust before the steel material corrodes, the plating layer that has turned into white rust disappears, and then the steel material corrodes to generate red rust.

A steel sheet to be plated will be described.

The shape of the steel sheet is mainly a sheet material, but the size thereof is not particularly limited. A plated steel sheet that is a sheet material manufactured in a normal hot-dip galvanizing step and that is manufactured in a step of immersing the sheet material in a molten metal and solidifying the molten metal, such as a continuous hot-dip galvanizing step (CGL), corresponds to the steel sheet. When these sheet materials are processed (including welding) and combined, the sheet materials can be processed into various products, and a steel structural member (pre-plating product) excellent in corrosion resistance can be manufactured.

A material of an original sheet of the steel sheet is not particularly limited. As the steel material, for example, various steel sheets such as a general steel, a pre-plating steel in which various metals are thinly plated, an Al-killed steel, an ultra low carbon steel, a high carbon steel, various high tensile strength steels, and some high alloy steels (a steel containing a corrosion resistance reinforcing element such as Ni or Cr) are applicable. In addition, as for the steel sheet, conditions for a method for manufacturing the steel sheet (a blast furnace material or an electric furnace material), a method for manufacturing the steel sheet (a hot rolling method, a pickling method, a cold rolling method, or the like), and the like are not particularly limited.

Next, the plating layer will be described. The plating layer according to the present embodiment includes a Zn—Al—Mg-based alloy layer. When an alloying element such as Al or Mg is added to Zn, corrosion resistance is improved. Therefore, the plating layer according to the present embodiment has corrosion resistance equivalent to that of a normal galvanized layer even when it is a thin film, for example, the thickness thereof is about half of that of the normal galvanized layer. Therefore, in the present invention, corrosion resistance equivalent to or higher than that of the galvanized layer is ensured with a thin film similarly. The plating layer may include an Al—Fe alloy layer.

The Zn—Al—Mg-based alloy layer is made of a Zn—Al—Mg-based alloy. The Zn—Al—Mg-based alloy means a ternary alloy containing Zn, Al, and Mg.

The Al—Fe alloy layer is an interface alloy layer between the steel material and the Zn—Al—Mg alloy layer.

That is, the plating layer may have a single-layer structure of the Zn—Al—Mg alloy layer or a multi-layer structure including the Zn—Al—Mg alloy layer and the Al—Fe alloy layer. In the case of the multi-layer structure, the Zn—Al—Mg alloy layer is preferably a layer constituting a surface of the plating layer.

Note that, as described later, when a hot-dip galvanized steel sheet manufactured by CGL or a hot-dip zinc alloy-plated steel sheet is used as a plating original sheet, traces of an interface alloy layer formed when the steel sheet is immersed remain. On the other hand, when an electrogalvanized steel sheet or the like is used as an original sheet, traces of the interface alloy layer or the like almost disappear, and an Al—Fe alloy layer or the like may hardly be confirmed. In addition, when a Ni pre-plated steel sheet is used as a plating original sheet, or Sn, Cr, or the like is used in advance in a plated steel sheet, these metals may be mixed into the interface alloy layer.

The steel material and the Zn—Al—Mg-based alloy layer are bonded to each other by the Al—Fe alloy layer. The thickness of the interface alloy layer can be controlled to any thickness by controlling the plating bath temperature, the plating bath immersion time, the line speed, and the wiping pressure during manufacture of the plated steel material. Usually, in a hot-dip plated steel sheet manufacturing method typified by a Sendzimir method, the Zn—Al—Mg alloy layer serves as a main body of the plating layer, and the thickness of the Al—Fe alloy layer is sufficiently small, and therefore the influence on corrosion resistance of the plating layer is small. In addition, the Al—Fe alloy layer is formed near an interface, and therefore has almost no influence on corrosion resistance in an initial stage of corrosion or an external appearance of the plating layer. Therefore, even when a steel sheet once plated by CGL or the like is used and immersed again in the plating bath of the present invention, the thickness of the interface alloy layer is often sufficiently small, and it is often difficult to confirm traces of the interface alloy layer.

The Al—Fe alloy layer is formed on a surface of the steel sheet (specifically, between the steel sheet and the Zn—Al—Mg alloy layer), and is a layer having an $Al_5Fe_2$ phase as a main phase in a microstructure. The Al—Fe alloy layer is formed by mutual atomic diffusion between a base metal (steel sheet) and a plating bath. When a continuous hot-dip plating method is used as a manufacturing method, the Al—Fe alloy layer is easily formed in a plating layer containing an Al element. In the present invention, since a certain concentration or more of Al is contained in the plating bath, the $Al_5Fe_2$ phase is formed most. However, the atomic diffusion takes time, and there is a portion where the Fe concentration is high in a portion close to the base metal. Therefore, a small amount of an AlFe phase, an $Al_3Fe$ phase, an $Al_5Fe_2$ phase, or the like may be partially contained in the Al—Fe alloy layer. In addition, since a certain concentration of Zn is also contained in the plating bath, a small amount of Zn or Si that is easily accumulated at an interface is also contained in the Al—Fe alloy layer.

In the present invention, the plating layer contains Si. Si is particularly easily incorporated into the Al—Fe alloy layer, and an Al—Fe—Si intermetallic compound phase may be formed. An intermetallic compound phase to be identified is, for example, an AlFeSi phase, and α, β, q1, q2-AlFeSi phases and the like exist as isomers. Therefore, these AlFeSi phases and the like may be detected in the Al—Fe alloy layer. The Al—Fe alloy layer containing these AlFeSi phases and the like is also referred to as an Al—Fe—Si alloy layer.

In addition, when a steel sheet including a pre-plating layer is used as the plating original sheet, Ni, Sn, Cr, and the like constituting the pre-plating layer may remain in a layered form in the interface alloy layer. In particular, an element having a high melting point tends to remain in a layered form in the interface alloy layer, and may be mixed in the Al—Fe alloy layer or present as an intermetallic compound containing these elements. The low melting point metal such as Sn is less likely to leave traces thereof and cannot be confirmed in some cases.

Since the thickness of the entire plating layer depends on plating conditions, the upper limit and the lower limit of the thickness of the entire plating layer are not particularly limited. The thickness of the entire plating layer depends on, for example, the viscosity and specific gravity of the plating bath in a normal hot-dip plating method. Furthermore, the weight per unit area of the plating is adjusted according to a pulling-up speed of the steel sheet (plating original sheet) and the strength of wiping. The absolute maximum value of the thickness of the plating layer formed by a normal hot-dip plating method is often 100 μm or less in continuous hot-dip plating and 200 μm or less in batch type plating.

On an outermost surface of the plating layer, an oxide film of a constituent element of the plating layer is preferably formed with a thickness of about less than 1 μm. Since an element contained in the plating layer is usually bonded to oxygen on a surface of the plating layer, there is a thin oxide film in which a bond of Zn—O, Mg—O, Al—O, Si—O, Ca—O, or the like, or Mg—Al—O or Al—Si—O is confirmed by surface analysis such as X-ray photoelectron spectroscopy (XPS). An element that is relatively easily oxidized tends to be present on the plating surface. These oxides are useful coatings for ensuring high corrosion resistance in water, but have extremely thin thicknesses of less than 1 μm. Therefore, it is difficult to confirm accurate action thereof with an electron microscope or the like. In the present invention, presence of these oxides is confirmed by X-ray diffraction measurement as described later.

Next, the average chemical composition of the plating layer will be described. When the plating layer has a single-layer structure of the Zn—Al—Mg alloy layer, the average chemical composition of the entire plating layer is the average chemical composition of the Zn—Al—Mg alloy layer. When the plating layer has a multi-layer structure of the Al—Fe alloy layer and the Zn—Al—Mg alloy layer, the average chemical composition of the entire plating layer is the average chemical composition of total of the Al—Fe alloy layer and the Zn—Al—Mg alloy layer.

In the continuous hot-dip plating method, the chemical composition of the Zn—Al—Mg alloy layer is usually almost the same as that of the plating bath because formation reaction of the plating layer is almost completed in the plating bath. In the continuous hot-dip plating method, the Al—Fe alloy layer is instantaneously formed and grown immediately after immersion in the plating bath. Formation reaction of the Al—Fe alloy layer is completed in the plating bath, and the thickness of the Al—Fe alloy layer is often sufficiently smaller than that of the Zn—Al—Mg alloy layer. Therefore, unless a special heat treatment such as a heat alloying treatment is performed after plating, the average chemical composition of the entire plating layer is substantially equal to the chemical composition of the Zn—Al—Mg alloy layer, and the components of the Al—Fe alloy layer and the like can be ignored.

Al: More than 30.0% and 50.0% or Less

Al is an element mainly constituting the plating layer. In the Zn—Al—Mg-based plating, an Al phase is mainly formed in the plating layer. When the Al content is 30.0% or less, a Zn phase and a ternary eutectic structure (Zn/Al/$MgZn_2$ ternary eutectic structure containing a Zn phase, an Al phase, and a $MgZn_2$ phase) are formed in a solidification process of the plating layer. The Zn phase and the $MgZn_2$ phase contained in the ternary eutectic structure have insufficient corrosion resistance in water. Therefore, the Al content is more than 30.0% in order to prevent formation of the Zn phase and the ternary eutectic structure. On the other hand, when the Al content exceeds 50.0%, the melting point of the plating bath rises, and as a result, growth of the Al—Fe alloy layer is active, a large amount of Fe is contained in the plating layer, and performance of the plating layer is impaired. Therefore, the Al content is 50.0% or less.

Mg: More than 5.0% and 15.0% or Less

Similarly to Zn, Mg is an element mainly constituting the plating layer. When the amount of Mg is insufficient, corrosion resistance in salt-containing water tends to be low, and therefore the Mg content is more than 5.0%. On the other hand, when the Mg content is more than 15.0%, there is a problem in soundness of the plating layer, and it is difficult to ensure corrosion resistance in water (simulated acid rain and seawater (salt water)). Therefore, the Mg content is 15.0% or less.

Element Group a

Sn: 0% or more and 0.70% or less

Bi: 0% or more and 0.30% or less

In: 0% or more and 0.30% or less

Total amount ΣA of Sn, Bi and In: 0% or more and 0.70% or less

Since each element of the element group A (Sn, Bi, and In) is an element that can be optionally contained, the content of each element is 0% or more. When Sn is contained, $Mg_9Sn_5$ tends to be formed in the plating layer. Bi forms $Mg_3Bi_2$, and In forms $Mg_3In$, for example. As a result, corrosion resistance in salt water tends to be improved. When these elements are contained in a small amount, an influence on corrosion resistance in water (simulated acid rain and seawater (salt water)) is small, but when these elements are excessively contained, the corrosion resistance in simulated acid rain and salt water is extremely deteriorated, and therefore it is necessary to limit the upper limits of the amounts of these elements. Since any element exhibits similar action and effect, it is necessary to control the total amount of these elements as the element group A. The total amount of the element group A needs to be 0.70% or less.

Element Group B

Ca: 0.03% to 0.60%

Y: 0% to 0.30%

La: 0% to 0.30%

Ce: 0% to 0.30%

Total amount ΣB of Ca, Y, La, and Ce: 0.03% or more and 0.60% or less

In order to ensure corrosion resistance in water (simulated acid rain and seawater (salt water)), it is necessary to form the Al—Ca—Si-based compound near an interface between the plating layer and the steel sheet. In particular, Ca tends to be bonded to Si, and the Al—Ca—Si-based compound is easily formed when a component range of $1 \leq Si/\Sigma B \leq 5$ is satisfied. When the Ca content is high, $Al_{2.15}Zn_{1.85}Ca$ and the like are also formed in addition to the Al—Ca—Si-based compound. Since these compounds have high corrosion resistance to simulated acid rain and salt water and are bonded to, particularly Si and formed around the interface alloy layer near the base metal, it is presumed that these compounds contribute to corrosion resistance of the base metal near the interface in water while ensuring plating adhesion. Note that, adjustment of formation of these compounds near the interface has a close relation with a manufacturing method disclosed in the present invention. From the above, the Ca content is 0.03% to 0.60%.

Elements that play a role similar to that of Ca are Y, La, and Ce. These elements are optional additive elements, and tend to be replaced with Ca when contained. Note that, when Ca is not contained, even when Y, La, and Ce are contained, sufficient performance is not exhibited in some cases. Y, La, and Ce are each contained in a range of 0.30% or less, thereby forming mutual substituents and functioning similarly to Ca in water (simulated acid rain and seawater (salt water)). However, when the amounts of Y, La, and Ce each exceed 0.30%, corrosion resistance in water (simulated acid rain and seawater (salt water)) is extremely deteriorated. Therefore, the amounts of Y, La, and Ce are each 0.30% or less.

In addition, even when the total amount of the elements of the element group B is excessive, corrosion resistance in water (simulated acid rain and seawater (salt water)) is deteriorated. Therefore, the total amount ΣB of Ca, Y, La, and Ce is 0.03% or more and 0.60% or less.

Si:

Si is more than 0.5% and 1.0% or less when Al is more than 30.0% and less than 35.0%.

Si is 0.03% or more and 1.0% or less when Al is 35.0% or more and 50.0% or less.

Si is an element necessary for forming an intermetallic compound in the plating layer. In a plating bath in which Al is 35.0% or more and 50.0% or less, the plating bath temperature usually exceeds 500° C. in many cases. When the steel sheet is immersed in the plating bath in this temperature range, Al—Fe alloying reaction excessively proceeds, an Fe concentration of the plating layer increases, and corrosion resistance in water tends to be deteriorated. Therefore, when Al is 35.0% or more, the Si content needs to be 0.03% or more. When Si is contained in the plating layer, an Al—Ca—Si-based compound is formed, and excessive Al—Fe reaction is suppressed. Note that, as described above, formation of the Al—Ca—Si-based compound has a close relation with a manufacturing method disclosed in the present invention. This compound and the like are accumulated near the interface between the plating layer and the steel sheet, and suppresses Fe diffusion, and a microstructure in the plating layer can form an appropriate microstructure according to a solidification process.

On the other hand, when Al is in a range of more than 30.0% and less than 35.0%, the Al content is relatively small, and corrosion resistance in water tends to be insufficient. In this case, when the Si content is more than 0.5%, an Al—Si—O oxide is formed on a surface of the plating layer, and corrosion resistance in water can be ensured. Therefore, when Al is in a range of more than 30.0% and less than 35.0%, the Si content is more than 0.5%. Note that, in order to form the Al—Si—O oxide, it is necessary to form the plating layer in an atmosphere having an oxygen concentration equal to or higher than a certain concentration.

Si is an element that is extremely easily bonded to Ca, and easily forms various Al—Ca—Si compounds such as CaAlSi, $Al_2CaSi_2$, $Ca_2Al_4Si_3$, and $Ca_2Al_3Si_4$. However, the excessive amount of Si impairs corrosion resistance of the plating layer in water. Therefore, the Si content is 1.0% or less.

Element Group C

Cr: 0% or more and 0.25% or less
Ti: 0% or more and 0.25% or less
Ni: 0% or more and 1.0% or less
Co: 0% or more and 0.25% or less
V: 0% or more and 0.25% or less
Nb: 0% or more and 0.25% or less
Cu: 0% or more and 0.25% or less
Mn: 0% or more and 0.25% or less
Total amount EC of Cr, Ti, Ni, Co, V, Nb, Cu, and Mn: 0% or more and 1.00% or less An element of the element group C is a metal element that can be contained in the plating layer, and may be contained therein. These metal elements tend to be replaced with Al, Zn, or the like in the plating layer to move a potential of the plating layer nobler, and corrosion resistance in water (particularly in simulated acid rain) tends to be improved when these metal elements are contained in this concentration range. When these elements are excessively contained, an intermetallic compound containing these elements is formed. Therefore, the corrosion resistance in water is deteriorated. Therefore, the amounts of Cr, Ti, Co, V, Nb, Cu, and Mn are each 0.25% or less. The amount of Ni is 1.0% or less. The total amount of the elements of the element group C is 0 to 1.00%.

Fe: 0% or More and 5.0% or Less

Since the hot-dip plated steel sheet of the present embodiment is manufactured by a continuous hot-dip plating method, Fe may be diffused into the plated layer from the plating original sheet during manufacturing. Fe may be contained up to 5.0% in the plating layer, but a change in corrosion resistance due to inclusion of this element has not been confirmed. Therefore, the Fe content is 0 to 5.0%.

Element Group D

Sr: 0% or more and 0.5% or less
Sb: 0% or more and 0.5% or less
Pb: 0% or more and 0.5% or less
B: 0% or more and 0.5% or less
Li: 0% or more and 0.5% or less
Zr: 0% or more and 0.5% or less
Mo: 0% or more and 0.5% or less
W: 0% or more and 0.5% or less
Ag: 0% or more and 0.5% or less
P: 0% or more and 0.5% or less
Total amount ΣD of Sr, Sb, Pb, B, Li, Zr, Mo, W, Ag, and P: 0% or more and 0.5% or less An element of the element group D may be contained in the plating layer. These elements have similar effects to the elements of the element group C described above, and are elements that are relatively more easily contained than the element group C. Therefore, the content of each element of the element group D is 0 to 0.5%. The total amount of the elements of the element group D is 0 to 0.5%.

Remainder: Zn and Impurities

The remainder preferably contains Zn. The hot-dip plated steel sheet of the present embodiment is a highly versatile Zn-based plated steel sheet, and for example, can impart appropriate sacrificial corrosion resistance to the steel sheet by containing a certain amount or more of Zn for the purpose of ensuring the sacrificial corrosion resistance. Regarding corrosion resistance in water having a low salt concentration, the Al content is preferably large. However, in water containing a relatively large amount of salt, such as seawater, it is necessary to ensure corrosion resistance by inclusion of a Zn—Mg-based intermetallic compound such as $MgZn_2$ in order to ensure corrosion resistance. In order to ensure the required amount of the Zn—Mg-based intermetallic compound, the remainder contains Zn.

The impurity refers to a component that is contained in a raw material or mixed in a manufacturing step and not intentionally contained. For example, in the plating layer, a small amount of component other than Fe may be mixed as the impurity due to mutual atomic diffusion between the steel material (base metal) and the plating bath.

In addition, the plating layer according to the present embodiment needs to satisfy the following formulas (1) to (3). Sn, Si, Mg, and Ca in formulas (1) to (3) represent the amounts (mass %) of the respective elements in the plating layer.

$$Sn \leq Si \quad (1)$$

$$15 \leq Mg/Si \quad (2)$$

$$1.0 \leq Si/Ca \leq 5.0 \quad (3)$$

$$Sn \leq Si$$

The Si content needs to be equal to or more than the Sn content. When the Si content is less than the Sn content, excessive Fe is diffused from the steel sheet into the plating layer, and it is difficult to form a target intermetallic compound.

$$15 \leq Mg/Si$$

Furthermore, the Si content needs to satisfy 15≤Mg/Si. This improves corrosion resistance in water (simulated acid rain and seawater (salt water)). When the Si content with respect to the Mg content is increased and Mg/Si is less than 15, a large amount of $Mg_2Si$ is formed in the plating layer, and corrosion resistance in water (simulated acid rain and seawater (salt water)) cannot be sufficiently exhibited. 20≤Mg/Si is preferably satisfied. When Mg/Si is 20 or more, corrosion resistance in salt water is further improved.

$$1.0 \leq Si/Ca \leq 5.0$$

Si and Ca are easily bonded to each other to form a compound. In addition, Y, La, or Ce is also easily bonded to Si similarly. When Si/Ca is less than 1.0, a large amount of a Ca—Al—Zn-based compound is formed, an Al—Ca—Si-based compound is hardly formed near an interface between the plating layer and the steel sheet, and corrosion resistance in water is significantly impaired. When Si/Ca exceeds 5.0, an effect of inclusion of Ca in the plating layer is reduced, a large amount of $Mg_2Si$ is formed, an Al—Ca—Si-based compound is not formed, and corrosion resistance in water is significantly impaired. Therefore, this index is introduced as a control index. When 1.0≤Si/Ca≤5.0 is satisfied, corrosion resistance in salt water is improved. 1.0≤Si/Ca≤4.0 is more preferably satisfied. As a result, the amount of $Mg_2Si$ is suppressed, a sufficient amount of Al—X—Si is formed, and corrosion resistance in water can be sufficiently ensured. $1.0 \leq Si/Ca \leq 3.0$ is still more preferably satisfied. This further improves corrosion resistance in salt water.

In order to identify the average chemical composition of the plating layer, an acid solution is obtained in which the plating layer is peeled off and dissolved with an acid containing an inhibitor that suppresses corrosion of the base metal (steel material). Next, the obtained acid solution is measured by ICP emission spectrometry or an ICP-MS method to obtain the chemical composition. The type of the acid is not particularly limited as long as the acid can dissolve the plating layer. If the area and weight before and after peeling are measured, a plating adhesion amount ($g/m^2$) can also be obtained at the same time.

Next, the intermetallic compound contained in the plating layer will be described. Since the plating layer of the present embodiment is made of Zn—Al—Mg-based alloy plating, the plating layer contains a Zn phase, an Al phase, and a $MgZn_2$ phase. Although corrosion resistance varies depending on the amount of each phase, corrosion resistance in an environment in water (simulated acid rain and seawater (salt water)) can be ensured by controlling a plating microstructure such as inclusion of an intermetallic compound.

Zn Phase

A Zn phase is present in the plating layer, and mainly present as a ternary eutectic structure ($Zn/Al/MgZn_2$ ternary eutectic structure). There is also a Zn phase that is not contained in the ternary eutectic structure. The Zn phase and the ternary eutectic structure containing the Zn phase have low corrosion resistance in water (simulated acid rain and seawater (salt water)), and disappear in a short period of time when immersed in water, and therefore it is necessary not to contain the Zn phase. In the present invention, presence or absence of the Zn phase is strictly limited, and Zn contained in the plating layer is formed into a solid solution in an Al phase, or formed into a $MgZn_2$ phase serving as an intermetallic compound. This makes it possible to ensure corrosion resistance of the plating layer in water (simulated acid rain and seawater (salt water)).

Al Phase

An Al phase is present in a massive form as an Al primary phase in the plating layer. The plating layer in the present invention contains a certain amount of Zn, but the Al phase present in a massive form contains at most about 35% of Zn. Therefore, the Al primary phase in a massive is strictly an Al—Zn phase. An Al—Zn phase is an aggregate of extremely fine grains, and is a microstructure in which fine grains of several nm to about 3 μm are aggregated when confirmed by a crystal size. There is a case where a microstructure containing a fine Al phase and a fine Zn phase is confirmed by X-ray diffraction, TEM, or the like, and such a fine microstructure is also referred to as an Al phase in the present invention. The Al phase that may contain at most about 35% of Zn forms a stable oxide film such as $Al_2O_3$ on a surface, and has high underwater corrosion resistance particularly in water (simulated acid rain). It is presumed that an Al concentration of more than 35% is required for this oxide film. On the other hand, in water containing salt, $Al_2O_3$ cannot be stably present, and corrosion resistance is extremely deteriorated.

$MgZn_2$ Phase

A $MgZn_2$ phase is present in the plating layer and present in a massive form as the $MgZn_2$ phase. In addition, the $MgZn_2$ phase is contained as fine grains in a certain amount in a dendritic microstructure formed when the $MgZn_2$ phase is solidified together with an Al phase on an Al—$MgZn_2$ eutectic line or a ternary eutectic structure ($Zn/Al/MgZn_2$ ternary eutectic structure). The $MgZn_2$ phase has favorable corrosion resistance in water and high corrosion resistance in both simulated acid rain and salt water. On the other hand, corrosion resistance of the $MgZn_2$ phase depends on a grain size, and $MgZn_2$ or the like contained in the ternary eutectic structure tends to corrode due to coupling reaction or the like. $MgZn_2$ contained in the ternary eutectic structure exhibits a diffraction peak of a (102) plane in X-ray diffraction measurement. Therefore, by reducing the amount of the $MgZn_2$ phase exhibiting an orientation of the (102) plane, corrosion resistance in water (simulated acid rain and seawater (salt water)) tends to be improved.

As described above, as a result of improving the plating layer for the purpose of ensuring corrosion resistance in water (simulated acid rain and seawater (salt water)), the present inventors have found that corrosion resistance in water can be ensured by formation of a specific intermetallic compound. In order to determine inclusion of a specific intermetallic compound in the plating layer, an X-ray diffraction method is preferably used. This detection method can obtain average information of the plating layer as compared with SEM observation, TEM observation, or the like, has small selectivity of a measurement site (field of view), and is excellent in quantification. If measurement conditions are defined, when a specific intermetallic compound is present, a diffraction peak intensity is obtained at a fixed ratio at the same angle (2θ). Therefore, the internal structure of the plating layer can be easily estimated.

Conditions for obtaining an X-ray diffraction image are as follows.

An X-ray diffraction method targeting Cu as an X-ray source is most convenient because average information of constituent phases in the plating layer can be obtained. As an example of measurement conditions, a voltage of 50 kV and a current of 300 mA are used as an X-ray condition. An X-ray diffractometer is not particularly limited, and for example, a sample horizontal strong X-ray diffractometer RINT-TTR III manufactured by Rigaku Corporation can be used.

Hereinafter, a substance to be measured in X-ray diffraction measurement will be described. Substances to be measured are Zn, Al, $MgZn_2$, and $Al_2O_5Si$.

Zn

Zn is a substance indicated by the database number (ICDD-JCPDS powder diffraction database) 00-004-0831. In a plating composition range of the present embodiment, there is one angle that is convenient for detecting Zn. That is, the angle is a diffraction angle 2θ of 36.30° ((002) plane).

Al

In the plating composition range of the present embodiment, there is one angle that is convenient for detecting Al. That is, the angle is a diffraction angle 2θ of 38.47° ((111) plane).

$MgZn_2$

In the plating composition range of the present embodiment, there is one angle that is convenient for detecting this intermetallic compound. That is, the angle is a diffraction angle 2θ of 19.67° ((100) plane).

$Al_2O_5Si$ $Al_2O_5Si$ is a substance indicated by the database number (ICDD-JCPDS powder diffraction database) 01-075-4827. In the composition range of the plating layer of the present embodiment, a diffraction angle convenient for detecting this intermetallic compound is 2θ of 16.18° ((110) plane).

Diffraction peaks at the above-described diffraction angles do not overlap with a diffraction peak of a main crystal structure of the plating layer, and therefore are convenient for quantification and determination of the content. That is, when a diffraction peak at which a diffraction intensity exceeds a certain level is obtained at these diffraction angles, it can be said that an intended substance is reliably contained.

In an X-ray diffraction pattern of a surface of the plating layer obtained by X-ray diffraction (X-ray output of 50 kV and 300 mA) using a Cu target with respect to the surface of the plating layer, $I_1$ obtained from X-ray diffraction peaks of Zn, Al, and $MgZn_2$ is defined by formula (A-1). In this case, in order to ensure corrosion resistance of the hot-dip plated steel sheet in water (simulated acid rain and seawater (salt water)), it is necessary to satisfy formula (A-2).

[Mathematical Formula 4]

$$I_1 = \frac{I\max(36.00\sim36.60^\circ)}{I\max(36.00\sim36.60^\circ) + I\max(38.00\sim39.00^\circ) + I\max(19.20\sim20.00^\circ)} \quad \text{(A-1)}$$

$$I_1 \leqq 0.10 \quad \text{(A-2)}$$

Imax (k to m°) in formula (A-1) represents an absolute maximum value of an X-ray diffraction intensity between a diffraction angle of k° and a diffraction angle of m°, and k and m each represent a diffraction angle indicated in formula (A-1).

That is, Imax (36.00 to 36.60°) in formula (A-1) is an absolute maximum value of an X-ray diffraction intensity between a diffraction angle of 36.00° and a diffraction angle of 36.60°, and corresponds to a diffraction intensity of a (002) plane of Zn.

That is, Imax (38.00 to 39.00°) is an absolute maximum value of an X-ray diffraction intensity between a diffraction angle of 38.00° and a diffraction angle of 39.00°, and corresponds to a diffraction intensity of a (111) plane of Al.

Imax (19.20 to 20.00°) is an absolute maximum value of an X-ray diffraction intensity between a diffraction angle of 19.20° and a diffraction angle of 20.00°, and corresponds to a diffraction intensity of a (100) plane of $MgZn_2$.

Therefore, $I_1$ defined by formula (A-1) represents a proportion of the diffraction intensity of Zn to the total diffraction intensity of Zn, Al, and $MgZn_2$, and the smaller $I_1$ means that the amount of the Zn phase in the plating layer is smaller. In the present embodiment, $I_1$ is 0.10 or less. This makes it possible to ensure corrosion resistance in water. That is, in the plating layer, a low proportion of the Zn phase leads to improvement of corrosion resistance in water, and the plating layer can be maintained in water. The lower limit of $I_1$ is not particularly limited, but may be 0 or more.

Next, when Al is more than 30.0% and less than 35.0%, the Al concentration in the plating layer is relatively low, and a coating that has a high barrier property and maintains corrosion resistance in water (particularly simulated acid rain), such as $Al_2O_3$, is deficient. On the other hand, when Al is more than 30.0% and less than 35.0%, Si is contained in an amount of more than 0.5% and 1.0% or less, and in the composition ranges of Al and Si, $Al_2O_5Si$ exhibiting high corrosion resistance in water can be obtained as an oxide film of the plating layer. Note that even when the Al amount is 35.0% or more, this oxide film is formed, and corrosion resistance in simulated acid rain tends to be improved. Therefore, when $I_2$ obtained from an X-ray diffraction peak of $Al_2O_5Si$ is defined by formula (B-1), it is necessary to satisfy formula (B-2).

[Mathematical Formula 5]

$$I_2 = \frac{I\max(15.60\sim16.60^\circ)}{I(15.60^\circ) + 0.58\{|I(15.60^\circ) - I(16.60^\circ)|\}} \quad \text{(B-1)}$$

$$1.05 \leqq I_2 \quad \text{(B-2)}$$

Note that Imax (k to m°) in formula (B-1) represents an absolute maximum value of an X-ray diffraction intensity between a diffraction angle of k° and a diffraction angle of m°, Imax (n°) represents an X-ray diffraction intensity at a diffraction angle of n°, and k, m, and n each represent a diffraction angle indicated in formulas (A-1) and (B-1).

Imax (15.60 to 16.60°) in formula (B-1) is an absolute maximum value of an X-ray diffraction intensity between a diffraction angle of 15.60° and a diffraction angle of 16.60°, and corresponds to a diffraction intensity of a (110) plane of $Al_2O_5Si$. I (15.60°) and I (16.60°) are X-ray diffraction intensities at diffraction angles of 15.60° and 16.60°, respectively, and correspond to the intensity of background of a diffraction peak of the (110) plane of $Al_2O_5Si$.

The numerator (Imax (15.60 to 16.60°)) of formula (B-1) is an intensity corresponding to a diffraction peak of $Al_2O_5Si$ at 2θ=16.18° (110 plane), and is a maximum diffraction intensity of a diffraction peak including an intensity of background. Since the diffraction angle of the (110) plane may deviate from 16.18° due to a measurement error of X-ray diffraction, an absolute maximum value between 15.60 to 16.60° is acquired.

The denominator of formula (B-1) is an intensity of background at a diffraction angle of 16.18°, obtained by calculation from diffraction intensities at 15.60° and 16.60°. That is, as illustrated in FIG. 1, a straight line connecting the diffraction line at 15.60° and the diffraction line at 16.60° is drawn. This straight line is a baseline of a diffraction peak. Next, I (15.60°)-I (16.60°) is obtained. In addition, the ratio (0.58/1.00=0.58) of the difference) (0.58°) between the diffraction angle of 15.60° and the diffraction angle of 16.18° to the difference) (1.00°) between the diffraction angle of 15.60° and the diffraction angle of 16.60° is obtained. Then, the intensity of background at the diffraction angle of 16.18° is calculated by the mathematical formula described in the denominator of the above formula (B-1).

By setting formula (B-1) as described above, the intensity of the diffraction peak of $Al_2O_5Si$ at 2θ=16.18° (110) can be accurately measured even when a measurement error or a fluctuation in the background occurs due to a difference in measurement conditions.

As illustrated in formula (B-2), when $I_2$ is 1.05 or more, corrosion resistance in water (particularly simulated acid rain) can be ensured. $I_2$ is preferably a large numerical value, but a clear effect in a range of Al: more than 30.0% to less than 35.0% cannot be confirmed.

When the Al concentration is 35.0% or more, corrosion resistance in salt water tends to be improved in a range of $I_2$=1.05 to 20. In addition, $I_2$ is more preferably $I_2$=3 to 20. The higher the Si concentration, the larger the numerical value tends to be. The lower limit of $I_2$ is not particularly limited, but may be 0 or more, or more than 0.

In order to satisfy formulas (A-2) and (B-2), the chemical composition of the plating layer needs to satisfy the scope of the present invention, and an appropriate plating manufacturing method, heat treatment, and atmosphere control need to be performed in a manufacturing method.

Next, in the composition range of the plating layer of the present embodiment, the $MgZn_2$ phase is crystallized. The $MgZn_2$ phase originally has high corrosion resistance in water, but when the $MgZn_2$ phase is surrounded by a fine Al phase or a fine Zn phase, corrosion is promoted by coupling reaction between these phases. In addition, the $MgZn_2$ phase has a corrosion potential lower than the Zn phase. Therefore, the $MgZn_2$ phase surrounded by the Al phase or the Zn phase is eluted early into water. Examples of such a $MgZn_2$ phase include a $MgZn_2$ phase contained in the ternary eutectic structure in the plating layer. Therefore, in the present embodiment, it is preferable to reduce the amount of the $MgZn_2$ phase contained in the ternary eutectic structure, and eventually, it is preferable to reduce the amount of the ternary eutectic structure.

There is one diffraction angle that is convenient for detecting the $MgZn_2$ phase contained in the ternary eutectic structure by X-ray diffraction. Most of the $MgZn_2$ phase contained in the ternary eutectic structure has a strong diffraction intensity of the (102) plane. That is, a diffraction peak appearing at a diffraction intensity at a diffraction angle 2θ of 28.73° ((102) plane) does not overlap with a diffraction peak of a main crystal structure of the plating layer, and therefore is convenient for quantification and determination of the content. That is, when a diffraction peak at which a diffraction intensity exceeds a certain level is obtained at these diffraction angles, it can be said that an intended phase is reliably contained.

The $MgZn_2$ phase exhibiting a crystal orientation other than the (102) plane is a coarse $MgZn_2$ phase that covers the Al phase by a peritectic reaction or a coarse $MgZn_2$ phase precipitated by a reaction other than a ternary eutectic reaction, and has high corrosion resistance in water. The $MgZn_2$ phase excellent in corrosion resistance in water exhibits diffraction intensities at diffraction angles 2θ of 20.78° ((002) plane) and 22.26° ((101) plane) in addition to the above-described diffraction angle 2θ of 19.67° ((100) plane). The diffraction peaks appearing at these diffraction angles do not overlap with a diffraction peak of a main crystal structure of the plating layer, and therefore are convenient for quantification and determination of the content.

Most of the $MgZn_2$ phase contained in the plating layer often exhibits any of the above four diffraction peaks. Therefore, in the hot-dip plated steel sheet of the present embodiment, in an X-ray diffraction pattern of a surface of the plating layer, measured under conditions in which an X-ray output is a voltage of 50 kV and a current of 300 mA using a Cu—Kα ray, when $I_3$ obtained from an X-ray diffraction peak of $MgZn_2$ is defined by formula (C-1), formula (C-2) is preferably satisfied.

[Mathematical Formula 6]

$$I_3 = \frac{I\max(28.52\sim28.92^\circ)}{\{I\max(19.20\sim20.00^\circ) + I\max(20.58\sim20.98^\circ) + I\max(22.06\sim22.46^\circ) + I\max(28.52\sim28.92^\circ)\}} \quad \text{(C-1)}$$

$$I_3 \leqq 0.03 \quad \text{(C-2)}$$

Note that Imax (k to m°) in formula (C-1) represents an absolute maximum value of an X-ray diffraction intensity between a diffraction angle of k° and a diffraction angle of m°, and k and m each represent a diffraction angle indicated in formula (C-1).

That is, Imax (28.52 to 28.92°) in formula (C-1) is an absolute maximum value of an X-ray diffraction intensity between a diffraction angle of 28.52° and a diffraction angle of 28.92°, and corresponds to a diffraction intensity of a (102) plane of $MgZn_2$. This $MgZn_2$ corresponds to the $MgZn_2$ phase contained in the ternary eutectic structure.

Imax (19.20 to 20.00°) is an absolute maximum value of an X-ray diffraction intensity between a diffraction angle of 19.20° and a diffraction angle of 20.00°, and corresponds to a diffraction intensity of a (100) plane of $MgZn_2$.

Imax (20.58 to 20.98°) is an absolute maximum value of an X-ray diffraction intensity between a diffraction angle of 20.58° and a diffraction angle of 20.98°, and corresponds to a diffraction intensity of a (002) plane of $MgZn_2$.

Imax (22.06 to 22.45°) is an absolute maximum value of an X-ray diffraction intensity between a diffraction angle of 22.06° and a diffraction angle of 22.45°, and corresponds to a diffraction intensity of a (101) plane of $MgZn_2$.

Therefore, $I_3$ defined by formula (C-1) represents a proportion of the diffraction intensity of the $MgZn_2$ phase contained in the ternary eutectic structure to the total diffraction intensity of $MgZn_2$ contained in the plating layer, and the smaller $I_3$ means that the amount of the $MgZn_2$ phase contained in the ternary eutectic structure, and eventually, the amount of the ternary eutectic structure is smaller. In the present embodiment, $I_3$ is 0.03 or less. As a result, the $MgZn_2$ phase present as the ternary eutectic structure almost disappears, and corrosion resistance in simulated acid rain and salt water is further improved. The lower limit of $I_3$ is not particularly limited, but may be 0 or more. In order to control $I_3$, it is preferable to control immersion time in a plating bath in a two-stage plating method.

The plated steel sheet of the present embodiment includes a steel sheet and a plating layer formed on a surface of the steel sheet. Zn—Al—Mg-based plating is usually formed by metal deposition and solidification reaction. The easiest means for forming the plating layer is to form the plating layer on the surface of the steel sheet by a hot-dip plating method. The plating layer can be formed by a Sendzimir method, a flux method, a two-stage plating method, or the like.

In the present embodiment, in order to appropriately control the form of the interface alloy layer, a manufacturing method corresponding to a two-stage plating method is preferable. A reason why the two-stage plating method is preferably adopted is as follows. A plating bath with Al of more than 30.0% is usually required to have a bath temperature of 520° C. or higher in order to melt the plating bath and perform hot-dip plating. When a Sendzimir method or the like is adopted using such a plating bath, a reduced Fe surface and the plating bath rapidly react with each other, and an Al—Fe alloy layer tends to grow thick. The hot-dip plated steel sheet of the present embodiment may be used as a material of a pre-plating product, but such a thick interface alloy layer brings about various adverse effects such as peeling of a plating layer during processing of the hot-dip plated steel sheet and early occurrence of Fe rust during corrosion. Therefore, in the manufacturing method of the present embodiment, it is necessary to adopt a manufacturing method corresponding to the two-stage plating method and to use a plating original sheet capable of suppressing the reaction between the Fe surface and the plating bath as the plating original sheet. In the plating original sheet, the plating thickness required for ensuring performance of the plating layer manufactured as a product of the present invention needs to be at least 10 μm or more, and more preferably 20 μm or more. At this time, the thickness of the interface alloy layer needs to be less than 10% of the entire plating layer, and more preferably less than 1 μm. The thickness of the plating layer is more preferably 80 μm or less from a viewpoint of poor plating appearance such as a sagging pattern.

Note that, in a case where the Sendzimir method has to be adopted, it is acceptable when a plating bath containing more than 35.0% of Al is used. Note that a plated steel sheet that is hardly melted in Fe and has a barrier coating effect for suppressing reaction between the plating bath and Fe is required as the plating original sheet, and a steel sheet to which a Ni or Cr pre-plating layer is attached in an amount of 0.7 g/m$^2$ or more for one surface needs to be used as the original sheet. Ni and Cr have a barrier effect of Fe diffusion. Note that, even in this case, formation of the Al—Ca—Si alloy layer to be contained in the plating layer of the present embodiment tends to be suppressed, solidification of the plating layer barely minimizes an influence of Fe diffusion, and appropriate plating solidification occurs. Furthermore, although an Al—Si—O oxide is required in order to ensure corrosion resistance in water, corrosion resistance in simulated acid rain can be ensured, but corrosion resistance tends to be poor in salt water. This phenomenon is considered to be caused by the fact that even when manufacture is possible with a preferable range of the thickness of the plating layer, predetermined performance cannot be exhibited because the thickness of the interface alloy layer is around 10% or more.

Hereinafter, a preferable method for manufacturing a hot-dip plated steel sheet of the present embodiment will be described.

In the method for manufacturing a hot-dip plated steel sheet of the present embodiment, the hot-dip plated steel sheet is manufactured by a continuous hot-dip plating method in which a plating original sheet is continuously immersed in a hot-dip plating bath and then pulled up. Note that, as described above, since the hot-dip plating bath used in the manufacturing method of the present embodiment has a high Al content, the bath temperature is relatively high, and when the steel sheet is immersed as it is therein as a plating original sheet, reaction between the plating bath and a base metal is active. As a result, a large amount of Fe is diffused into a plating layer, an interface alloy layer made of an Fe—Al alloy is formed thick, and adhesion of the plating layer is largely reduced. Therefore, in the present embodiment, a galvanized steel sheet or a pre-plated steel sheet on which a predetermined amount or more of plating layer is formed is used as the plating original sheet. As a result, the reaction between the plating bath and the base metal is suppressed, and the interface alloy layer can be thinned.

The galvanized steel sheet used as the plating original sheet preferably has a plating adhesion amount of at least 40 g/m$^2$ or more, preferably 100 g/m$^2$ or more for one surface. That is, this means that the plating thickness is about 10 μm or more, more preferably about 21 μm or more in terms of the thickness of the plating layer. There is no limitation on a method for manufacturing the plating layer of the plating original sheet, and either a hot-dip plating method or an electroplating method may be used. The interface alloy layer of the plating original sheet needs to be less than 1 μm, and the main component of the plating layer needs to be Zn, but for example, the plating layer may contain 1% or less of Al. When a plated steel sheet on which the interface alloy layer is formed from the beginning is used as the original sheet, the reaction changes, which is not preferable. That is, since the interface alloy layer formed at the time of manufacturing the plating original sheet remains as it is as the interface alloy layer even after the two-stage plating, this alloy layer is strictly limited. The thickness of the alloy layer is preferably less than 1 μm, and essentially less than 10% of the thickness of the entire plating layer.

In addition, as the galvanized steel sheet serving as an original sheet, a Zn—Al—Mg-based plated steel sheet containing, in a plating layer, elements contained in the plating layer of the present invention, such as Al and Mg, may be used. Even in such a Zn—Al—Mg-based plated steel sheet, the thickness of the interface alloy layer needs to be less than 1 μm. Note that, in general, in a hot-dip galvanized steel sheet or a zinc-based alloy-plated steel sheet manufactured by a continuous hot-dip plating line, the thickness of the interface alloy layer hardly exceeds 1 μm because of immersion time. Therefore, it is more preferable to use the hot-dip galvanized steel sheet or the zinc-based alloy-plated steel sheet as the plating original sheet.

When a galvanized steel sheet is immersed in a hot-dip plating bath, a plating layer included in the steel sheet is easily replaced with a metal element in the hot-dip plating bath, and a plating layer containing components of the plating bath is formed while reaction between the plating bath and the base metal is suppressed. The galvanized steel sheet has a plating layer mainly containing zinc on a steel sheet, and a hot-dip plated steel sheet has an interface alloy layer between the plating layer and the steel sheet.

Examples of a pre-plated steel sheet used as the plating original sheet include a pre-plated steel sheet in which a plating layer of Zn, Ni, Cr, Sn, or an alloy of these elements is pre-plated in advance with a plating thickness of 30 μm or less. When the pre-plated steel sheet is immersed in a hot-dip plating bath, the pre-plating layer is easily replaced with a metal element in the hot-dip plating bath, and a plating layer containing components of the plating bath is formed while reaction between the plating bath and the base metal is suppressed. Constituent elements of the pre-plating layer, such as Sn, Ni, and Cr, react with Al and Si in the plating bath to act as a barrier layer that suppresses diffusion of Fe. Furthermore, it is also possible to eliminate bare spots (portions where a plated metal is repelled by an oxide film or the like) due to the components contained in the plating bath.

In addition, there is no problem even when a Sn-plated steel sheet as a low-temperature plated layer or an electro-Zn—Ni-plated steel sheet is used as the plating original sheet.

In the manufacturing method of the present embodiment, the plating original sheet is immersed in a hot-dip plating bath and then pulled up. Components of the plating layer can be controlled by components of a plating bath to be prepared. In preparation of the plating bath, an alloy of the plating bath components is prepared by mixing predetermined amounts of pure metals, for example, by a dissolution method under an inert atmosphere.

By immersing a plating original sheet in a plating bath maintained at a predetermined concentration, a plating layer having substantially the same components as the plating bath is formed. Immersion time may be changed according to a plating adhesion amount used for the original sheet. The immersion time (seconds) is preferably in a range of M/30 (seconds) or more and M/10 (seconds) or less, where a value of the plating adhesion amount (g/m$^2$) for one surface is represented by M.

Furthermore, in order to satisfy the above formula (C-2), the immersion time (seconds) is preferably in a range of M/15 (seconds) or more and M/10 (seconds) or less.

In addition, the temperature of the plating original sheet at the time of immersion does not need to be raised in order to match the temperature of the plating bath, and may be room temperature (for example, 50° C. or lower). However, in a case of Zn-based plating, there is no problem even when the temperature is raised to at most about 600° C. (temperature at which the plating layer on a surface is not melted).

The various plating layers formed on the plating original sheet are exposed to the plating bath at 500° C. or higher and instantly melted immediately after being immersed in the plating bath. On the other hand, since the temperature of the base metal of the plated steel sheet is not sufficiently raised, reaction between Fe and the plating bath tends to be suppressed, and diffusion of Fe into the plating layer and formation of an intermetallic compound caused by Fe are largely suppressed. By immersion for a short time, replacement of the plating layer of the plating original sheet with the hot-dip plating layer occurs before Fe is diffused, and the plating original sheet is pulled up as it is.

When an oxide of Al—Si—O is formed on the plating layer immediately after the plating original sheet is pulled up from the plating bath, the atmosphere needs to be under an air environment (oxygen concentration of 2000 ppm or more). In addition, immediately after the plating original sheet is pulled up, the plating thickness can be controlled by wiping. In addition, it is preferable to control the steel sheet temperature so as not to exceed 500° C. in a series of plating solidification reactions. This is because Fe is rapidly diffused into the plating bath when the steel sheet temperature exceeds this temperature.

A series of manufacturing methods can be performed under an air environment. When the Al amount of the plating bath is more than 35.0%, manufacture is also possible in an inert atmosphere such as a nitrogen atmosphere, but in this case, an Al—Si—O oxide film is not formed.

Cooling of the plating layer is not particularly limited, and it is only required to cool and solidify the plating layer by spraying a $N_2$ gas, mist, or the like onto the plating layer.

After plating, various chemical conversion treatments and coating treatments may be performed. It is also possible to further impart a plating layer of Cr, Ni, Au, or the like by utilizing an uneven pattern on the plating surface, and to further apply coating to impart a design. In addition, in order to further enhance corrosion resistance, repair touch-up paint, a thermal spraying treatment, and the like may be performed in a welded portion, a processed portion, and the like.

In the hot-dip plated steel sheet of the present embodiment, a film may be formed on the plating layer. A film composed of a single layer or two or more layers can be formed. Examples of the type of the film immediately above the plating layer include a chromate film, a phosphate film, and a chromate-free film. A chromate treatment, a phosphating treatment, and a chromate-free treatment for forming these films can be performed by known methods.

The chromate treatment includes an electrolytic chromate treatment in which a chromate film is formed by electrolysis, a reaction type chromate treatment in which a film is formed by utilizing a reaction with a material and then an excess treatment liquid is washed away, and an application type chromate treatment in which a film is formed by applying a treatment liquid to an object to be coated and drying the treatment liquid without washing with water. Any treatment may be adopted.

Examples of the electrolytic chromate treatment include electrolytic chromate treatments using chromic acid, a silica sol, a resin (phosphate, acrylic resin, vinyl ester resin, vinyl acetate acrylic emulsion, carboxylated styrene-butadiene latex, diisopropanolamine-modified epoxy resin, and the like), and hard silica.

Examples of the phosphating treatment include zinc phosphate treatment, zinc calcium phosphate treatment, and manganese phosphate treatment.

The chromate-free treatment which does not impose a burden on the environment is particularly suitable. The chromate-free treatment includes an electrolytic chromate-free treatment in which a chromate-free film is formed by electrolysis, a reaction type chromate-free treatment in which a film is formed by utilizing a reaction with a material and then an excess treatment liquid is washed away, and an application type chromate-free treatment in which a film is formed by applying a treatment liquid to an object to be coated and drying the treatment liquid without washing with water. Any treatment may be adopted.

Further, an organic resin film composed of a single layer or two or more layers may be formed on the film immediately above the plating layer. The organic resin is not limited to a specific type, and examples thereof include polyester resins, polyurethane resins, epoxy resins, acrylic resins, polyolefin resins, and modified products of these resins. Here, the modified product refers to a resin obtained by reacting a reactive functional group included in the structure of these resins with another compound (a monomer, a crosslinking agent, or the like) having a functional group capable of reacting with the functional group in the structure.

As such an organic resin, one type or two or more types of organic resins (unmodified organic resins) may be mixed and used, or one type or two or more types of organic resins obtained by modifying, in the presence of at least one type of organic resin, at least one type of another organic resin may be mixed and used. The organic resin film may contain any coloring pigment or an antirust pigment. It is also possible to use a water-based organic resin prepared by dissolving or dispersing these organic resins in water.

Note that, in the present embodiment, corrosion resistance in acid rain water and corrosion resistance in salt water are measured and evaluated as follows. A case where both an evaluation of the corrosion resistance in acid rain water and an evaluation of the corrosion resistance in salt water are "E" is judged to be unacceptable, and the other cases are judged to be acceptable.

(Corrosion Resistance in Acid Rain Water)

Corrosion resistance in acid rain water is evaluated by a simulated acid rain corrosion resistance test. This test is a test assuming a situation in which acid rain in the air flows in. As simulated acid rain, test water obtained by adding NaCl, $HNO_3$, and $H_2SO_4$ to deionized water, and adjusting the pH of the mixture with NaOH such that the concentration of $Cl^-$ is 10 ppm, the concentration of $NO^{3-}$ is 20 ppm, the concentration of $SO_4^{2-}$ is 40 ppm, and the pH is 5.0±0.2 is prepared. 60 L of the test water is put into a cuboid container having a side length of 50 cm. A plated steel sheet test piece is attached to a distal end of a stainless steel shaft (φ 25 mm) with a jig and a bolt. The test piece is a disk having a diameter of 130 mm. A hole is formed at the center of the disk, and the distal end of the stainless steel shaft is fitted and fixed in the hole. The test piece is immersed in the test water, and the test piece is rotated at a high speed such that an outer peripheral speed of the test piece is 2.2 m/s. A portion where the test piece touches the jig is insulated by a tape seal or the like. The pH is constantly monitored, and when the pH is out of a range of 5.0±0.2, the pH is returned to 5.0 with dilute hydrochloric acid or a NaOH aqueous solution. The water temperature is kept in a range of 23 to 25° C. The test solution is replaced every 250 hours. After a lapse of 1000 hours, the test piece is taken out and immersed in a 30% chromic acid (VI) aqueous solution for 15 minutes, and a weight difference before and after immersion is measured to determine a corrosion loss ($g/m^2$). An end surface portion of the test piece is opened, and the center hole portion of the test piece is not evaluated. The evaluation criteria are as follows.

Corrosion loss of less than 5 $g/m^2$: Corrosion resistance in simulated acid rain is evaluated as "A"

Corrosion loss of 5 to less than 10 $g/m^2$: Corrosion resistance in simulated acid rain is evaluated as "B"

Corrosion loss of 10 to less than 20 $g/m^2$: Corrosion resistance in simulated acid rain is evaluated as "C"

Corrosion loss of 20 to less than 30 $g/m^2$: Corrosion resistance in simulated acid rain is evaluated as "D"

Corrosion loss of 30 $g/m^2$ or more: Corrosion resistance in simulated acid rain is evaluated as "E"

(Corrosion Resistance in Salt Water)

Corrosion resistance in salt water is evaluated by a corrosion resistance test in a salt water aqueous solution. This test is performed in a similar manner to the simulated acid rain corrosion resistance test except that the test water is replaced with a 5% NaCl aqueous solution. After a lapse of 1000 hours, a test piece is immersed in a 30% chromic acid (VI) aqueous solution for 15 minutes, and a corrosion loss before and after immersion is determined. The evaluation criteria are as follows.

Corrosion loss of less than 15 $g/m^2$: Corrosion resistance in salt water is evaluated as "S"

Corrosion loss of 15 to less than 20 $g/m^2$: Corrosion resistance in salt water is evaluated as "A"

Corrosion loss of 20 to less than 30 $g/m^2$: Corrosion resistance in salt water is evaluated as "B"

Corrosion loss of 30 to less than 40 $g/m^2$: Corrosion resistance in salt water is evaluated as "C"

Corrosion loss of 40 to less than 50 $g/m^2$: Corrosion resistance in salt water is evaluated as "D"

Corrosion loss of 50 $g/m^2$ or more: Corrosion resistance in salt water is evaluated as "E"

EXAMPLES

Plated steel sheets presented in Tables 2A to 5C were manufactured, and performance thereof was evaluated.

Various plating baths were prepared by mixing pure metals. An Fe powder was added to the components of the plating alloy after preparation of the plating bath such that the Fe concentration did not increase during the test.

Manufacturing conditions are as presented in Table 1 below. The unit of the plating adhesion amount for one surface of the original sheet is $g/m^2$. The heating temperature of the steel sheet before immersion in the plating bath was normal temperature to 800° C. The normal temperature was 50° C. or lower. Immersion time was 2 to 15 seconds.

TABLE 1

| Manufacturing method | Original sheet | Adhesion amount for one surface | Manufacturing method | Before immersion in plating bath Heating temperature | Immersion time | After immersion in plating bath Atmosphere |
|---|---|---|---|---|---|---|
| A | Cold-rolled steel sheet | — | Sendzimir | 800 | 3 | Air |
| A1 | 100% Ni-pre-plated steel sheet | (1.0 $g/m^2$) | Sendzimir | 600 | 3 | Air |
| A2 | 100% Cr-pre-plated steel sheet | (1.0 $g/m^2$) | Sendzimir | 600 | 3 | Air |
| B | Cold-rolled steel sheet | — | Sendzimir | 800 | 3 | Less than 2000 ppm |
| B1 | 100% Ni-pre-plated steel sheet | (1.0 $g/m^2$) | Sendzimir | 600 | 3 | Less than 2000 ppm |
| B2 | 100% Cr-pre-plated steel sheet | (1.0 $g/m^2$) | Sendzimir | 600 | 3 | Less than 2000 ppm |
| C | Hot-dip Zn(99.8%)-0.2% Al | 150 | Two-stage plating | Normal temperature | 15 | Air |
| D | Hot-dip Zn(99.8%)-0.2% Al | 150 | Two-stage plating | Normal temperature | 15 | Less than 2000 ppm |
| E | Hot-dip Zn(99.8%)-0.2% Al | 40 | Two-stage plating | Normal temperature | 3 | Air |
| F | Hot-dip Zn-6% Al-3% Mg | 175 | Two-stage plating | Normal temperature | 6 | Air |
| G | Hot-dip Zn-6% Al-3% Mg | 175 | Two-stage plating | Normal temperature | 6 | Less than 2000 ppm |
| H | Hot-dip Zn-6% Al-3% Mg | 40 | Two-stage plating | Normal temperature | 2 | Air |
| I | Electrogalvanized steel sheet | 100 | Two-stage plating | Normal temperature | 10 | Air |
| J | Electrogalvanized steel sheet | 40 | Two-stage plating | Normal temperature | 2 | Air |
| K | Electro-Zn-15% Ni-plated steel sheet | 100 | Two-stage plating | Normal temperature | 10 | Air |
| L | Electro-Sn | 100 | Two-stage plating | Normal temperature | 10 | Air |

Manufacturing methods A, A1, and A2: As a plating original sheet, a cold-rolled steel sheet, a Ni-pre-plated steel sheet, or a Cr-pre-plated steel sheet was used. The thickness of an interface alloy layer of the pre-plated steel sheet was less than 1 μm. As a manufacturing method, a CGL Sendzimir method was used. That is, before immersion in a plating bath, the plating original sheet was heated at a predetermined heating temperature for 60 seconds in a nitrogen atmosphere with 5% of $H_2$ (oxygen concentration: 20 ppm or less, dew point: −40° C.) to perform surface reduction. Thereafter, the steel sheet was cooled with a $N_2$ gas to a plating bath temperature, and immersed in the plating bath. After the steel sheet was pulled up, the thickness was adjusted by wiping such that the thickness for one surface was 20 μm, and the steel sheet was cooled in the air at an average cooling rate of 10° C./sec. Note that the plating adhesion amount was 20 μm for one surface also for manufacturing methods B to L.

Manufacturing methods B, B1, and B2: These manufacturing methods were the same as manufacturing methods A, A1, and A2 until immersion in the plating bath. After a steel sheet was pulled up from the plating bath, the steel sheet was covered with a sealing box and cooled in a nitrogen atmosphere having an oxygen concentration of less than 2000 ppm.

Manufacturing methods C, D, and E: As a plating original sheet, a hot-dip galvanized steel sheet prepared by a CGL Sendzimir method was used. Details thereof are as described in Table 1. The thickness of the interface alloy layer of the hot-dip galvanized steel sheet was less than 1 μm, which was less than 10% of the entire plating layer. A plating original sheet was immersed in the plating bath without being heated. The plating bath was maintained such that the plating bath temperature did not change before and after immersion. Treatment after pulling up in manufacturing methods C and E was similar to that in manufacturing methods A to A2, and treatment after pulling up in manufacturing method D was similar to that in manufacturing methods B to B2.

Manufacturing methods F, G, and H: As a plating original sheet, a molten Zn—Al—Mg alloy-plated steel sheet prepared by a CGL Sendzimir method was used. Details thereof are as described in Table 1. The thickness of the interface alloy layer of the hot-dip Zn—Al—Mg alloy-plated steel sheet was less than 1 μm, which was less than 10% of the entire plating layer. The plating step is as described in Table 1.

Manufacturing methods I, J, K, and L: As a plating original sheet, a plated steel sheet described in Table 1 was used. The thickness of the interface alloy layer of the plated steel sheet was less than 1 μm, which was less than 10% of the entire plating layer. The plating step is as described in Table 1.

The plating bath temperature was 550° C. for a plating bath having an Al amount of less than 35.0%, and 600° C. for a plating bath having an Al amount of 35.0% or more.

An intensity of an X-ray was measured as follows.

A hot-dip plated steel sheet after plating was cut into a size of 20 mm square. Measurement was performed using a high-angle X-ray diffractometer manufactured by Rigaku Corporation (model number RINT-TTR III) under conditions in which an X-ray output is a voltage of 50 kV and a current of 300 mA; copper (Cu) target; goniometer TTR (horizontal goniometer); slit width of Kβ filter: 0.05 mm; longitudinal limiting slit width: 2 mm; light receiving slit width: 8 mm; and light receiving slit 2: open, and under measurement conditions of scan speed: 5 deg./min; step width: 0.01 deg; and scan axis: 2θ (5 to 90°), and a cps intensity at each angle was obtained.

Corrosion resistance in simulated acid rain water and salt water was measured and evaluated as follows. Results are presented in Table.

(Corrosion Resistance in Acid Rain Water)

Corrosion resistance in acid rain water was evaluated by a simulated acid rain corrosion resistance test. This test is a test assuming a situation in which acid rain in the air flows in. As simulated acid rain, test water obtained by adding NaCl, $HNO_3$, and $H_2SO_4$ to deionized water, and adjusting the pH of the mixture with NaOH such that the concentration of $Cl^-$ was 10 ppm, the concentration of $NO^{3-}$ was 20 ppm, the concentration of $SO_4^{2-}$ was 40 ppm, and the pH was 5.0±0.2 was prepared. 60 L of the test water was put into a cuboid container having a side length of 50 cm. A plated steel sheet test piece was attached to a distal end of a stainless steel shaft (φ 25 mm) with a jig and a bolt. The test piece was a disk having a diameter of 130 mm. A hole was formed at the center of the disk, and the distal end of the stainless steel shaft was fitted and fixed in the hole. The test piece was immersed in the test water, and the test piece was rotated at a high speed such that an outer peripheral speed of the test piece is 2.2 m/s. A portion where the test piece touched the jig was insulated by a tape seal or the like. The pH was constantly monitored, and when the pH was out of a range of 5.0±0.2, the pH was returned to 5.0 with dilute hydrochloric acid or a NaOH aqueous solution. The water temperature was kept in a range of 23 to 25° C. The test solution was replaced every 250 hours. After a lapse of 1000 hours, the test piece was taken out and immersed in a 30% chromic acid (VI) aqueous solution for 15 minutes, and a weight difference before and after immersion was measured to determine a corrosion loss (g/m$^2$). An end surface portion of the test piece was opened, and the center hole portion of the test piece was not evaluated. Evaluation criteria were as follows. "E" was judged to be unacceptable.

- Corrosion loss of less than 5 g/m$^2$: Corrosion resistance in simulated acid rain is evaluated as "A"
- Corrosion loss of 5 to less than 10 g/m$^2$: Corrosion resistance in simulated acid rain is evaluated as "B"
- Corrosion loss of 10 to less than 20 g/m$^2$: Corrosion resistance in simulated acid rain is evaluated as "C"
- Corrosion loss of 20 to less than 30 g/m$^2$: Corrosion resistance in simulated acid rain is evaluated as "D"
- Corrosion loss of 30 g/m$^2$ or more: Corrosion resistance in simulated acid rain is evaluated as "E"

(Corrosion Resistance in Salt Water)

Corrosion resistance in salt water was evaluated by a corrosion resistance test in a salt water aqueous solution. This test was performed in a similar manner to the simulated acid rain corrosion resistance test except that the test water was replaced with a 5% NaCl aqueous solution. After a lapse of 1000 hours, a test piece is was immersed in a 30% chromic acid (VI) aqueous solution for 15 minutes, and a corrosion loss before and after immersion was determined. Evaluation criteria were as follows. "E" was judged to be unacceptable.

- Corrosion loss of less than 15 g/m$^2$: Corrosion resistance in salt water is evaluated as "S"
- Corrosion loss of 15 to less than 20 g/m$^2$: Corrosion resistance in salt water is evaluated as "A"
- Corrosion loss of 20 to less than 30 g/m$^2$: Corrosion resistance in salt water is evaluated as "B"
- Corrosion loss of 30 to less than 40 g/m$^2$: Corrosion resistance in salt water is evaluated as "C"
- Corrosion loss of 40 to less than 50 g/m$^2$: Corrosion resistance in salt water is evaluated as "D"
- Corrosion loss of 50 g/m$^2$ or more: Corrosion resistance in salt water is evaluated as "E"

In Nos. 1 and 44, the Al content was out of the scope of the present invention, as a result, $I_1$ was out of the scope of the invention, and therefore corrosion resistance in water was deteriorated.

In Nos. 54, 66, 69, and 73, the Si content was out of the scope of the present invention, as a result, $I_1$ was out of the scope of the present invention, and therefore corrosion resistance in water was deteriorated.

In Nos. 5 to 11, 14, 28 to 32, 35, 115 to 119, and 122, manufacturing conditions were out of the preferable range, as a result, $I_1$ and $I_2$ were out of the invention range, and corrosion resistance in water was deteriorated.

In Nos. 45 and 50, the Mg content was out of the scope of the present invention, as a result, $I_1$ was out of the scope of the invention, and therefore corrosion resistance in water was deteriorated.

In Nos. 51 to 53, the elements of the element group A were out of the scope of the present invention, as a result, $I_1$ was out of the scope of the invention, and therefore corrosion resistance in water was deteriorated.

In Nos. 55, 56, 58, 60, 62, 64, and 65, the elements of the element group B were out of the scope of the present invention, as a result, $I_1$ was out of the scope of the invention, and therefore corrosion resistance in water was deteriorated.

In Nos. 77, 79, 81, 83, 85, 87, 89, 91, 93, and 95, the elements of the element group C were out of the scope of the present invention, as a result, $I_1$ was out of the scope of the present invention, and therefore corrosion resistance in water was deteriorated.

In No. 97, Fe was out of the scope of the present invention, as a result, $I_1$ was out of the scope of the present invention, and therefore corrosion resistance in water was deteriorated.

In Nos. 99, 101, 103, 105, 107, 109, 111, 128, 130, 132, and 135, the elements of the element group D were out of the scope of the present invention, as a result, $I_1$ was out of the scope of the present invention, and therefore corrosion resistance in water was deteriorated.

Since No. 137 did not satisfy Si≤Sn, $I_1$ was out of the scope of the invention, and corrosion resistance in water was deteriorated.

In No. 139, Si/Ca was out of the scope of the present invention, as a result, $I_1$ was out of the scope of the present invention, and therefore corrosion resistance in water was deteriorated.

On the other hand, hot-dip plated steel sheets other than those described above were excellent in corrosion resistance in water.

TABLE 2A

| | | Plating | Chemical composition (mass %) Remainder: Zn and impurities | | | | | | | | | | |
|---|---|---|---|---|---|---|---|---|---|---|---|---|---|
| | | manufacturing | | | Additive element group A | | | | Additive element group B | | | | |
| No. | Category | method | Al | Mg | Sn | Bi | In | ΣA | Ca | Y | La | Ce | ΣB |
| 1 | Comparative Example | C | 30.0 | 9 | 0 | 0 | 0 | 0 | 0.2 | 0 | 0 | 0 | 0.2 |
| 2 | Example | C | 30.2 | 9 | 0 | 0 | 0 | 0 | 0.2 | 0 | 0 | 0 | 0.2 |
| 3 | Example | C | 31 | 14 | 0.1 | 0 | 0 | 0.1 | 0.2 | 0.1 | 0 | 0 | 0.3 |
| 4 | Example | C | 33 | 15.0 | 0.15 | 0 | 0 | 0.15 | 0.2 | 0.1 | 0.1 | 0 | 0.4 |
| 5 | Comparative Example | A | 33 | 15.0 | 0.15 | 0 | 0 | 0.15 | 0.2 | 0.1 | 0.1 | 0 | 0.4 |
| 6 | Comparative Example | A1 | 33 | 15.0 | 0.15 | 0 | 0 | 0.15 | 0.2 | 0.1 | 0.1 | 0 | 0.4 |
| 7 | Comparative Example | A2 | 33 | 15.0 | 0.15 | 0 | 0 | 0.15 | 0.2 | 0.1 | 0.1 | 0 | 0.4 |
| 8 | Comparative Example | B | 33 | 15.0 | 0.15 | 0 | 0 | 0.15 | 0.2 | 0.1 | 0.1 | 0 | 0.4 |
| 9 | Comparative Example | B1 | 33 | 15.0 | 0.15 | 0 | 0 | 0.15 | 0.2 | 0.1 | 0.1 | 0 | 0.4 |
| 10 | Comparative Example | B2 | 33 | 15.0 | 0.15 | 0 | 0 | 0.15 | 0.2 | 0.1 | 0.1 | 0 | 0.4 |
| 11 | Comparative Example | D | 33 | 15.0 | 0.15 | 0 | 0 | 0.15 | 0.2 | 0.1 | 0.1 | 0 | 0.4 |
| 12 | Example | E | 33 | 15.0 | 0.15 | 0 | 0 | 0.15 | 0.2 | 0.1 | 0.1 | 0 | 0.4 |
| 13 | Example | F | 33 | 15.0 | 0.15 | 0 | 0 | 0.15 | 0.2 | 0.1 | 0.1 | 0 | 0.4 |
| 14 | Comparative Example | G | 33 | 15.0 | 0.15 | 0 | 0 | 0.15 | 0.2 | 0.1 | 0.1 | 0 | 0.4 |
| 15 | Example | H | 33 | 15.0 | 0.15 | 0 | 0 | 0.15 | 0.2 | 0.1 | 0.1 | 0 | 0.4 |
| 16 | Example | I | 33 | 15.0 | 0.15 | 0 | 0 | 0.15 | 0.2 | 0.1 | 0.1 | 0 | 0.4 |
| 17 | Example | J | 33 | 15.0 | 0.15 | 0 | 0 | 0.15 | 0.2 | 0.1 | 0.1 | 0 | 0.4 |
| 18 | Example | K | 33 | 15.0 | 0.15 | 0 | 0 | 0.15 | 0.2 | 0.1 | 0.1 | 0 | 0.4 |
| 19 | Example | L | 33 | 15.0 | 0.15 | 0 | 0 | 0.15 | 0.2 | 0.1 | 0.1 | 0 | 0.4 |
| 20 | Example | C | 35.0 | 7.5 | 0.2 | 0 | 0 | 0.2 | 0.2 | 0.1 | 0.1 | 0.1 | 0.5 |
| 21 | Example | C | 37 | 7.5 | 0.2 | 0 | 0 | 0.2 | 0.2 | 0 | 0.1 | 0.2 | 0.5 |
| 22 | Example | C | 39 | 7.5 | 0.35 | 0 | 0 | 0.35 | 0.3 | 0 | 0.2 | 0 | 0.5 |
| 23 | Example | C | 41 | 7.5 | 0.5 | 0 | 0 | 0.5 | 0.3 | 0 | 0 | 0.2 | 0.5 |
| 24 | Example | C | 43 | 13 | 0.70 | 0 | 0 | 0.70 | 0.3 | 0.1 | 0 | 0.1 | 0.5 |
| 25 | Example | C | 45 | 7.5 | 0 | 0.1 | 0 | 0.1 | 0.4 | 0 | 0 | 0 | 0.4 |
| 26 | Example | A2 | 45 | 7.5 | 0 | 0.1 | 0 | 0.1 | 0.4 | 0 | 0 | 0 | 0.4 |
| 27 | Example | A1 | 45 | 7.5 | 0 | 0.1 | 0 | 0.1 | 0.4 | 0 | 0 | 0 | 0.4 |
| 28 | Comparative Example | A | 45 | 7.5 | 0 | 0.1 | 0 | 0.1 | 0.4 | 0 | 0 | 0 | 0.4 |
| 29 | Comparative Example | B | 45 | 7.5 | 0 | 0.1 | 0 | 0.1 | 0.4 | 0 | 0 | 0 | 0.4 |
| 30 | Comparative Example | B1 | 45 | 7.5 | 0 | 0.1 | 0 | 0.1 | 0.4 | 0 | 0 | 0 | 0.4 |
| 31 | Comparative Example | B2 | 45 | 7.5 | 0 | 0.1 | 0 | 0.1 | 0.4 | 0 | 0 | 0 | 0.4 |
| 32 | Comparative Example | D | 45 | 7.5 | 0 | 0.1 | 0 | 0.1 | 0.4 | 0 | 0 | 0 | 0.4 |

TABLE 2A-continued

| No. | Category | Plating manufacturing method | Chemical composition (mass %) Remainder: Zn and impurities | | | | | | | | | | |
|---|---|---|---|---|---|---|---|---|---|---|---|---|---|
| | | | | | Additive element group A | | | | Additive element group B | | | | |
| | | | Al | Mg | Sn | Bi | In | ΣA | Ca | Y | La | Ce | ΣB |
| 33 | Example | E | 45 | 7.5 | 0 | 0.1 | 0 | 0.1 | 0.4 | 0 | 0 | 0 | 0.4 |
| 34 | Example | F | 45 | 7.5 | 0 | 0.1 | 0 | 0.1 | 0.4 | 0 | 0 | 0 | 0.4 |
| 35 | Comparative Example | G | 45 | 7.5 | 0 | 0.1 | 0 | 0.1 | 0.4 | 0 | 0 | 0 | 0.4 |
| 36 | Example | H | 45 | 7.5 | 0 | 0.1 | 0 | 0.1 | 0.4 | 0 | 0 | 0 | 0.4 |
| 37 | Example | I | 45 | 7.5 | 0 | 0.1 | 0 | 0.1 | 0.4 | 0 | 0 | 0 | 0.4 |
| 38 | Example | J | 45 | 7.5 | 0 | 0.1 | 0 | 0.1 | 0.4 | 0 | 0 | 0 | 0.4 |
| 39 | Example | K | 45 | 7.5 | 0 | 0.1 | 0 | 0.1 | 0.4 | 0 | 0 | 0 | 0.4 |
| 40 | Example | L | 45 | 7.5 | 0 | 0.1 | 0 | 0.1 | 0.4 | 0 | 0 | 0 | 0.4 |
| 41 | Example | C | 47 | 7.5 | 0 | 0 | 0.1 | 0.1 | 0.4 | 0 | 0 | 0 | 0.4 |
| 42 | Example | C | 49 | 7.5 | 0.1 | 0.1 | 0 | 0.2 | 0.4 | 0 | 0 | 0 | 0.4 |
| 43 | Example | C | 50.0 | 15.0 | 0 | 0.1 | 0.1 | 0.2 | 0.5 | 0 | 0 | 0 | 0.5 |
| 44 | Comparative Example | C | 50.2 | 7.5 | 0 | 0 | 0 | 0 | 0.3 | 0 | 0 | 0 | 0.3 |
| 45 | Comparative Example | C | 32 | 5.0 | 0 | 0 | 0 | 0 | 0.2 | 0 | 0 | 0 | 0.2 |
| 46 | Example | C | 32 | 9 | 0.1 | 0 | 0.1 | 0.2 | 0.2 | 0 | 0 | 0 | 0.2 |
| 47 | Example | C | 32 | 11 | 0.1 | 0.1 | 0.1 | 0.3 | 0.2 | 0 | 0 | 0 | 0.2 |
| 48 | Example | C | 32 | 13 | 0 | 0.2 | 0 | 0.2 | 0.2 | 0 | 0 | 0 | 0.2 |
| 49 | Example | C | 32 | 15.0 | 0 | 0.30 | 0 | 0.3 | 0.2 | 0 | 0 | 0 | 0.2 |

The underlined value indicates that the value is out of the scope of the present invention or out of preferable manufacturing conditions.

TABLE 2B

| No. | Category | Plating manufacturing method | Chemical composition (mass %) Remainder: Zn and impurities | | | | | | | | | | |
|---|---|---|---|---|---|---|---|---|---|---|---|---|---|
| | | | | | Additive element group A | | | | Additive element group B | | | | |
| | | | Al | Mg | Sn | Bi | In | ΣA | Ca | Y | La | Ce | ΣB |
| 50 | Comparative Example | C | 32 | 15.2 | 0 | 0 | 0 | 0 | 0.2 | 0 | 0 | 0 | 0.2 |
| 51 | Comparative Example | C | 34 | 14 | 0.75 | 0 | 0 | 0.75 | 0.2 | 0 | 0 | 0 | 0.2 |
| 52 | Comparative Example | C | 34 | 10 | 0 | 0.35 | 0 | 0.35 | 0.2 | 0 | 0 | 0 | 0.2 |
| 53 | Comparative Example | C | 34 | 10 | 0 | 0 | 0.35 | 0.35 | 0.2 | 0 | 0 | 0 | 0.2 |
| 54 | Comparative Example | C | 34 | 10 | 0.4 | 0.2 | 0.15 | 0.75 | 0.3 | 0 | 0 | 0 | 0.3 |
| 55 | Comparative Example | C | 34 | 10 | 0 | 0 | 0 | 0 | 0 | 0 | 0 | 0 | 0 |
| 56 | Comparative Example | C | 34 | 10 | 0 | 0 | 0 | 0 | 0 | 0.1 | 0.1 | 0.1 | 0.3 |
| 57 | Example | C | 34 | 12 | 0.1 | 0 | 0 | 0.1 | 0.60 | 0 | 0 | 0 | 0.60 |
| 58 | Comparative Example | C | 34 | 12 | 0.1 | 0 | 0 | 0.1 | 0.65 | 0 | 0 | 0 | 0.65 |
| 59 | Example | C | 34 | 10 | 0 | 0 | 0 | 0 | 0.3 | 0.30 | 0 | 0 | 0.60 |
| 60 | Comparative Example | C | 34 | 10 | 0 | 0 | 0 | 0 | 0.3 | 0.32 | 0 | 0 | 0.62 |
| 61 | Example | C | 34 | 10 | 0 | 0 | 0 | 0 | 0.3 | 0 | 0.30 | 0 | 0.60 |
| 62 | Comparative Example | C | 34 | 10 | 0 | 0 | 0 | 0 | 0.3 | 0 | 0.32 | 0 | 0.62 |
| 63 | Example | C | 34 | 10 | 0 | 0 | 0 | 0 | 0.3 | 0 | 0 | 0.30 | 0.60 |
| 64 | Comparative Example | C | 34 | 8 | 0 | 0 | 0 | 0 | 0.3 | 0 | 0 | 0.32 | 0.62 |
| 65 | Comparative Example | C | 34 | 8 | 0 | 0 | 0 | 0 | 0.4 | 0.1 | 0.1 | 0.02 | 0.62 |
| 66 | Comparative Example | C | 34 | 9.5 | 0 | 0 | 0 | 0 | 0.4 | 0 | 0 | 0 | 0.4 |
| 67 | Example | C | 34.5 | 9.5 | 0.1 | 0 | 0 | 0.1 | 0.3 | 0 | 0 | 0 | 0.3 |
| 68 | Example | C | 34.5 | 13.5 | 0.1 | 0 | 0 | 0.1 | 0.3 | 0 | 0 | 0 | 0.3 |
| 69 | Comparative Example | C | 34.5 | 15.0 | 0.1 | 0 | 0 | 0.1 | 0.3 | 0 | 0 | 0 | 0.3 |
| 70 | Example | C | 34.5 | 10.5 | 0.1 | 0 | 0 | 0.1 | 0.3 | 0 | 0 | 0 | 0.3 |
| 71 | Example | C | 35.5 | 5.05 | 0 | 0 | 0 | 0 | 0.03 | 0 | 0 | 0 | 0.03 |
| 72 | Example | C | 36 | 14.5 | 0 | 0 | 0 | 0 | 0.3 | 0 | 0 | 0 | 0.3 |
| 73 | Comparative Example | C | 36 | 14.5 | 0 | 0 | 0 | 0 | 0.3 | 0 | 0 | 0 | 0.3 |
| 74 | Example | C | 36 | 13.5 | 0 | 0 | 0 | 0 | 0.3 | 0 | 0 | 0 | 0.3 |
| 75 | Example | C | 38 | 10 | 0.08 | 0 | 0 | 0.08 | 0.2 | 0 | 0 | 0 | 0.2 |

TABLE 2B-continued

| No. | Category | Plating manufacturing method | Chemical composition (mass %) Remainder: Zn and impurities | | | | | | | | | | |
|---|---|---|---|---|---|---|---|---|---|---|---|---|---|
| | | | | | Additive element group A | | | | Additive element group B | | | | |
| | | | Al | Mg | Sn | Bi | In | ΣA | Ca | Y | La | Ce | ΣB |
| 76 | Example | C | 38 | 6.5 | 0.05 | 0 | 0 | 0.05 | 0.1 | 0 | 0 | 0 | 0.1 |
| 77 | Comparative Example | C | 38 | 6.5 | 0.03 | 0 | 0 | 0.03 | 0.3 | 0 | 0 | 0 | 0.3 |
| 78 | Example | C | 38 | 6.5 | 0.03 | 0 | 0 | 0.03 | 0.3 | 0 | 0 | 0 | 0.3 |
| 79 | Comparative Example | C | 38 | 6.5 | 0.03 | 0 | 0 | 0.03 | 0.3 | 0 | 0 | 0 | 0.3 |
| 80 | Example | C | 38 | 6.5 | 0.03 | 0 | 0 | 0.03 | 0.3 | 0 | 0 | 0 | 0.3 |
| 81 | Comparative Example | C | 38 | 6.5 | 0.03 | 0 | 0 | 0.03 | 0.3 | 0 | 0 | 0 | 0.3 |
| 82 | Example | C | 38 | 6.5 | 0.03 | 0 | 0 | 0.03 | 0.3 | 0 | 0 | 0 | 0.3 |
| 83 | Comparative Example | C | 38 | 6.5 | 0.03 | 0 | 0 | 0.03 | 0.3 | 0 | 0 | 0 | 0.3 |
| 84 | Example | C | 38 | 6.5 | 0.05 | 0 | 0 | 0.05 | 0.3 | 0 | 0 | 0 | 0.3 |
| 85 | Comparative Example | C | 38 | 6.5 | 0.05 | 0 | 0 | 0.05 | 0.3 | 0 | 0 | 0 | 0.3 |
| 86 | Example | C | 38 | 6.5 | 0.05 | 0 | 0 | 0.05 | 0.3 | 0 | 0 | 0 | 0.3 |
| 87 | Comparative Example | C | 38 | 6.5 | 0.05 | 0 | 0 | 0.05 | 0.3 | 0 | 0 | 0 | 0.3 |
| 88 | Example | C | 38 | 6.5 | 0.05 | 0 | 0 | 0.05 | 0.3 | 0 | 0 | 0 | 0.3 |
| 89 | Comparative Example | C | 38 | 6.5 | 0.05 | 0 | 0 | 0.05 | 0.3 | 0 | 0 | 0 | 0.3 |
| 90 | Example | C | 38 | 6.5 | 0.05 | 0 | 0 | 0.05 | 0.3 | 0 | 0 | 0 | 0.3 |
| 91 | Comparative Example | C | 38 | 6.5 | 0.05 | 0 | 0 | 0.05 | 0.3 | 0 | 0 | 0 | 0.3 |
| 92 | Example | C | 38 | 6.5 | 0.05 | 0 | 0 | 0.05 | 0.3 | 0 | 0 | 0 | 0.3 |
| 93 | Comparative Example | C | 38 | 6.5 | 0.05 | 0 | 0 | 0.05 | 0.3 | 0 | 0 | 0 | 0.3 |
| 94 | Example | C | 38 | 6.5 | 0.05 | 0 | 0 | 0.05 | 0.3 | 0 | 0 | 0 | 0.3 |
| 95 | Comparative Example | C | 38 | 6.5 | 0.05 | 0 | 0 | 0.05 | 0.3 | 0 | 0 | 0 | 0.3 |
| 96 | Example | C | 40 | 6.5 | 0.05 | 0 | 0 | 0.05 | 0.3 | 0 | 0 | 0 | 0.3 |
| 97 | Comparative Example | C | 40 | 6.5 | 0.05 | 0 | 0 | 0.05 | 0.3 | 0 | 0 | 0 | 0.3 |
| 98 | Example | C | 40 | 6.5 | 0.05 | 0 | 0 | 0.05 | 0.3 | 0 | 0 | 0 | 0.3 |
| 99 | Comparative Example | C | 40 | 6.5 | 0.05 | 0 | 0 | 0.05 | 0.3 | 0 | 0 | 0 | 0.3 |

The underlined value indicates that the value is out of the scope of the present invention or out of preferable manufacturing conditions.

TABLE 2C

| No. | Category | Plating manufacturing method | Chemical composition (mass %) Remainder: Zn and impurities | | | | | | | | | | |
|---|---|---|---|---|---|---|---|---|---|---|---|---|---|
| | | | | | Additive element group A | | | | Additive element group B | | | | |
| | | | Al | Mg | Sn | Bi | In | ΣA | Ca | Y | La | Ce | ΣB |
| 100 | Example | C | 40 | 6.5 | 0.05 | 0 | 0 | 0.05 | 0.3 | 0 | 0 | 0 | 0.3 |
| 101 | Comparative Example | C | 40 | 6.5 | 0.05 | 0 | 0 | 0.05 | 0.3 | 0 | 0 | 0 | 0.3 |
| 102 | Example | C | 40 | 6.5 | 0.05 | 0 | 0 | 0.05 | 0.3 | 0 | 0 | 0 | 0.3 |
| 103 | Comparative Example | C | 40 | 6.5 | 0.05 | 0 | 0 | 0.05 | 0.3 | 0 | 0 | 0 | 0.3 |
| 104 | Example | C | 40 | 6.5 | 0.05 | 0 | 0 | 0.05 | 0.3 | 0 | 0 | 0 | 0.3 |
| 105 | Comparative Example | C | 40 | 6.5 | 0.05 | 0 | 0 | 0.05 | 0.3 | 0 | 0 | 0 | 0.3 |
| 106 | Example | C | 40 | 6.5 | 0.05 | 0 | 0 | 0.05 | 0.3 | 0 | 0 | 0 | 0.3 |
| 107 | Comparative Example | C | 40 | 6.5 | 0.05 | 0 | 0 | 0.05 | 0.3 | 0 | 0 | 0 | 0.3 |
| 108 | Example | C | 40 | 6.5 | 0.05 | 0 | 0 | 0.05 | 0.3 | 0 | 0 | 0 | 0.3 |
| 109 | Comparative Example | C | 40 | 6.5 | 0.05 | 0 | 0 | 0.05 | 0.3 | 0 | 0 | 0 | 0.3 |
| 110 | Example | C | 40 | 6.5 | 0.05 | 0 | 0 | 0.05 | 0.3 | 0 | 0 | 0 | 0.3 |
| 111 | Comparative Example | C | 40 | 6.5 | 0.05 | 0 | 0 | 0.05 | 0.3 | 0 | 0 | 0 | 0.3 |
| 112 | Example | C | 40 | 6.5 | 0.05 | 0 | 0 | 0.05 | 0.3 | 0 | 0 | 0 | 0.3 |
| 113 | Example | A2 | 40 | 6.5 | 0.05 | 0 | 0 | 0.05 | 0.3 | 0 | 0 | 0 | 0.3 |
| 114 | Example | A1 | 40 | 6.5 | 0.05 | 0 | 0 | 0.05 | 0.3 | 0 | 0 | 0 | 0.3 |
| 115 | Comparative Example | A | 40 | 6.5 | 0.05 | 0 | 0 | 0.05 | 0.3 | 0 | 0 | 0 | 0.3 |
| 116 | Comparative Example | B | 40 | 6.5 | 0.05 | 0 | 0 | 0.05 | 0.3 | 0 | 0 | 0 | 0.3 |

TABLE 2C-continued

| No. | Category | Plating manufacturing method | Chemical composition (mass %) Remainder: Zn and impurities | | | | | | | | | | |
|---|---|---|---|---|---|---|---|---|---|---|---|---|---|
| | | | | | Additive element group A | | | | Additive element group B | | | | |
| | | | Al | Mg | Sn | Bi | In | ΣA | Ca | Y | La | Ce | ΣB |
| 117 | Comparative Example | B1 | 40 | 6.5 | 0.05 | 0 | 0 | 0.05 | 0.3 | 0 | 0 | 0 | 0.3 |
| 118 | Comparative Example | B2 | 40 | 6.5 | 0.05 | 0 | 0 | 0.05 | 0.3 | 0 | 0 | 0 | 0.3 |
| 119 | Comparative Example | D | 40 | 6.5 | 0.05 | 0 | 0 | 0.05 | 0.3 | 0 | 0 | 0 | 0.3 |
| 120 | Example | E | 40 | 6.5 | 0.05 | 0 | 0 | 0.05 | 0.3 | 0 | 0 | 0 | 0.3 |
| 121 | Example | F | 40 | 6.5 | 0.05 | 0 | 0 | 0.05 | 0.3 | 0 | 0 | 0 | 0.3 |
| 122 | Comparative Example | G | 40 | 6.5 | 0.05 | 0 | 0 | 0.05 | 0.3 | 0 | 0 | 0 | 0.3 |
| 123 | Example | H | 40 | 6.5 | 0.05 | 0 | 0 | 0.05 | 0.3 | 0 | 0 | 0 | 0.3 |
| 124 | Example | I | 40 | 6.5 | 0.05 | 0 | 0 | 0.05 | 0.3 | 0 | 0 | 0 | 0.3 |
| 125 | Example | J | 40 | 6.5 | 0.05 | 0 | 0 | 0.05 | 0.3 | 0 | 0 | 0 | 0.3 |
| 126 | Example | K | 40 | 6.5 | 0.05 | 0 | 0 | 0.05 | 0.3 | 0 | 0 | 0 | 0.3 |
| 127 | Example | L | 40 | 6.5 | 0.05 | 0 | 0 | 0.05 | 0.3 | 0 | 0 | 0 | 0.3 |
| 128 | Comparative Example | C | 40 | 6.5 | 0.05 | 0 | 0 | 0.05 | 0.3 | 0 | 0 | 0 | 0.3 |
| 129 | Example | C | 40 | 6.5 | 0.05 | 0 | 0 | 0.05 | 0.3 | 0 | 0 | 0 | 0.3 |
| 130 | Comparative Example | C | 40 | 6.5 | 0.05 | 0 | 0 | 0.05 | 0.3 | 0 | 0 | 0 | 0.3 |
| 131 | Example | C | 40 | 6.5 | 0.05 | 0 | 0 | 0.05 | 0.3 | 0 | 0 | 0 | 0.3 |
| 132 | Comparative Example | C | 40 | 6.5 | 0.05 | 0 | 0 | 0.05 | 0.3 | 0 | 0 | 0 | 0.3 |
| 133 | Example | C | 40 | 6.5 | 0.05 | 0 | 0 | 0.05 | 0.3 | 0 | 0 | 0 | 0.3 |
| 134 | Example | C | 40 | 6.5 | 0.05 | 0 | 0 | 0.05 | 0.3 | 0 | 0 | 0 | 0.3 |
| 135 | Comparative Example | C | 40 | 6.5 | 0.05 | 0 | 0 | 0.05 | 0.3 | 0 | 0 | 0 | 0.3 |
| 136 | Example | C | 40 | 6.5 | 0.05 | 0 | 0 | 0.05 | 0.3 | 0 | 0 | 0 | 0.3 |
| 137 | Comparative Example | C | 40 | 6.5 | 0.13 | 0 | 0 | 0.13 | 0.1 | 0 | 0 | 0 | 0.1 |
| 138 | Example | C | 40 | 6.5 | 0.1 | 0 | 0 | 0.1 | 0.1 | 0 | 0 | 0 | 0.1 |
| 139 | Comparative Example | C | 40 | 6.5 | 0.05 | 0 | 0 | 0.05 | 0.3 | 0 | 0 | 0 | 0.3 |
| 140 | Example | C | 38 | 6.5 | 0.05 | 0 | 0 | 0.05 | 0.08 | 0 | 0 | 0 | 0.08 |

The underlined value indicates that the value is out of the scope of the present invention or out of preferable manufacturing conditions.

TABLE 3A

| No. | Category | Chemical composition (mass %) Remainder: Zn and impurities | | | | | | | | | | |
|---|---|---|---|---|---|---|---|---|---|---|---|---|
| | | | Element group C | | | | | | | | | |
| | | Si | Cr | Ti | Ni | Co | V | Nb | Cu | Mn | ΣC | Fe |
| 1 | Comparative Example | 0.52 | 0 | 0 | 0 | 0 | 0 | 0 | 0 | 0 | 0 | 0.1 |
| 2 | Example | 0.52 | 0.1 | 0 | 0 | 0 | 0 | 0 | 0 | 0 | 0.1 | 0.1 |
| 3 | Example | 0.75 | 0 | 0.1 | 0 | 0 | 0 | 0 | 0 | 0 | 0.1 | 0.05 |
| 4 | Example | 1.0 | 0 | 0 | 0.5 | 0 | 0 | 0 | 0 | 0 | 0.5 | 0.1 |
| 5 | Comparative Example | 1.0 | 0 | 0 | 0.5 | 0 | 0 | 0 | 0 | 0 | 0.5 | 6.0 |
| 6 | Comparative Example | 1.0 | 0 | 0 | 0.7 | 0 | 0 | 0 | 0 | 0 | 0.7 | 4.3 |
| 7 | Comparative Example | 1.0 | 0.5 | 0 | 0.5 | 0 | 0 | 0 | 0 | 0 | 1.00 | 4.6 |
| 8 | Comparative Example | 1.0 | 0 | 0 | 0.5 | 0 | 0 | 0 | 0 | 0 | 0.5 | 6.0 |
| 9 | Comparative Example | 1.0 | 0 | 0 | 0.7 | 0 | 0 | 0 | 0 | 0 | 0.7 | 4.3 |
| 10 | Comparative Example | 1.0 | 0.5 | 0 | 0.5 | 0 | 0 | 0 | 0 | 0 | 1.00 | 4.5 |
| 11 | Comparative Example | 1.0 | 0 | 0 | 0.5 | 0 | 0 | 0 | 0 | 0 | 0.5 | 0.1 |
| 12 | Example | 1.0 | 0 | 0 | 0.5 | 0 | 0 | 0 | 0 | 0 | 0.5 | 0.1 |
| 13 | Example | 1.0 | 0 | 0 | 0.5 | 0 | 0 | 0 | 0 | 0 | 0.5 | 0.1 |
| 14 | Comparative Example | 1.0 | 0 | 0 | 0.5 | 0 | 0 | 0 | 0 | 0 | 0.5 | 0.1 |
| 15 | Example | 1.0 | 0 | 0 | 0.5 | 0 | 0 | 0 | 0 | 0 | 0.5 | 0.1 |
| 16 | Example | 1.0 | 0 | 0 | 0.5 | 0 | 0 | 0 | 0 | 0 | 0.5 | 0.1 |
| 17 | Example | 1.0 | 0 | 0 | 0.5 | 0 | 0 | 0 | 0 | 0 | 0.5 | 0.1 |
| 18 | Example | 1.0 | 0 | 0 | 0.5 | 0 | 0 | 0 | 0 | 0 | 0.5 | 0.1 |

TABLE 3A-continued

| | | Chemical composition (mass %) Remainder: Zn and impurities | | | | | | | | | | |
|---|---|---|---|---|---|---|---|---|---|---|---|---|
| | | | Element group C | | | | | | | | | |
| No. | Category | Si | Cr | Ti | Ni | Co | V | Nb | Cu | Mn | ΣC | Fe |
| 19 | Example | 1.0 | 0 | 0 | 0.5 | 0 | 0 | 0 | 0 | 0 | 0.5 | 0.1 |
| 20 | Example | 0.2 | 0 | 0 | 0 | 0.10 | 0 | 0 | 0 | 0 | 0.10 | 0.1 |
| 21 | Example | 0.3 | 0 | 0 | 0 | 0 | 0.10 | 0 | 0 | 0 | 0.10 | 0.1 |
| 22 | Example | 0.4 | 0 | 0 | 0 | 0 | 0 | 0.10 | 0 | 0 | 0.10 | 0.1 |
| 23 | Example | 0.5 | 0 | 0 | 0 | 0 | 0 | 0 | 0.10 | 0 | 0.10 | 0.1 |
| 24 | Example | 0.75 | 0 | 0 | 0 | 0 | 0 | 0 | 0 | 0.10 | 0.10 | 0.1 |
| 25 | Example | 0.4 | 0 | 0 | 0 | 0 | 0 | 0 | 0 | 0 | 0 | 0.1 |
| 26 | Example | 0.4 | 0.25 | 0 | 0 | 0 | 0 | 0 | 0 | 0 | 0.25 | 4.9 |
| 27 | Example | 0.4 | 0 | 0 | 0.7 | 0 | 0 | 0 | 0 | 0 | 0.7 | 4.3 |
| 28 | Comparative Example | 0.4 | 0 | 0 | 0 | 0 | 0 | 0 | 0 | 0 | 0 | 4.6 |
| 29 | Comparative Example | 0.4 | 0 | 0 | 0 | 0 | 0 | 0 | 0 | 0 | 0 | 6.0 |
| 30 | Comparative Example | 0.4 | 0 | 0 | 0.7 | 0 | 0 | 0 | 0 | 0 | 0.7 | 4.3 |
| 31 | Comparative Example | 0.4 | 0 | 0 | 0 | 0 | 0 | 0 | 0 | 0 | 0 | 4.5 |
| 32 | Comparative Example | 0.4 | 0 | 0 | 0 | 0 | 0 | 0 | 0 | 0 | 0 | 0.1 |
| 33 | Example | 0.4 | 0 | 0 | 0 | 0 | 0 | 0 | 0 | 0 | 0 | 0.1 |
| 34 | Example | 0.4 | 0 | 0 | 0 | 0 | 0 | 0 | 0 | 0 | 0 | 0.1 |
| 35 | Comparative Example | 0.4 | 0 | 0 | 0 | 0 | 0 | 0 | 0 | 0 | 0 | 0.1 |
| 36 | Example | 0.4 | 0 | 0 | 0 | 0 | 0 | 0 | 0 | 0 | 0 | 0.1 |
| 37 | Example | 0.4 | 0 | 0 | 0 | 0 | 0 | 0 | 0 | 0 | 0 | 0.1 |
| 38 | Example | 0.4 | 0 | 0 | 0 | 0 | 0 | 0 | 0 | 0 | 0 | 0.1 |
| 39 | Example | 0.4 | 0 | 0 | 0 | 0 | 0 | 0 | 0 | 0 | 0 | 0.1 |
| 40 | Example | 0.4 | 0 | 0 | 0 | 0 | 0 | 0 | 0 | 0 | 0 | 0.1 |
| 41 | Example | 0.4 | 0 | 0 | 0 | 0 | 0 | 0 | 0 | 0 | 0 | 0.1 |
| 42 | Example | 0.4 | 0 | 0 | 0 | 0 | 0 | 0 | 0 | 0 | 0 | 0.1 |
| 43 | Example | 1.0 | 0 | 0 | 0 | 0 | 0 | 0 | 0 | 0 | 0 | 0.1 |
| 44 | Comparative Example | 0.4 | 0 | 0 | 0 | 0 | 0 | 0 | 0 | 0 | 0 | 0.1 |
| 45 | Comparative Example | 0.2 | 0 | 0 | 0 | 0 | 0 | 0 | 0 | 0 | 0 | 0.1 |
| 46 | Example | 0.55 | 0 | 0 | 0 | 0 | 0 | 0 | 0 | 0 | 0 | 0.1 |
| 47 | Example | 0.7 | 0 | 0 | 0 | 0 | 10 | 0 | 0 | 0 | 0 | 0.1 |
| 48 | Example | 0.7 | 0 | 0 | 0 | 0 | 0 | 0 | 0 | 0 | 0 | 0.1 |
| 49 | Example | 0.8 | 0 | 0 | 0 | 0 | 0 | 0 | 0 | 0 | 0 | 0.1 |

The underlined value indicates that the value is out of the scope of the present invention.

TABLE 3B

| | | Chemical composition (mass %) Remainder: Zn and impurities | | | | | | | | | | |
|---|---|---|---|---|---|---|---|---|---|---|---|---|
| | | | Element group C | | | | | | | | | |
| No. | Category | Si | Cr | Ti | Ni | Co | V | Nb | Cu | Mn | ΣC | Fe |
| 50 | Comparative Example | 0.8 | 0 | 0 | 0 | 0 | 0 | 0 | 0 | 0 | 0 | 0.03 |
| 51 | Comparative Example | 0.8 | 0 | 0 | 0 | 0 | 0 | 0 | 0 | 0 | 0 | 0.1 |
| 52 | Comparative Example | 0.55 | 0 | 0 | 0 | 0 | 0 | 0 | 0 | 0 | 0 | 0.15 |
| 53 | Comparative Example | 0.55 | 0 | 0 | 0 | 0 | 0 | 0 | 0 | 0 | 0 | 0.1 |
| 54 | Comparative Example | 0.50 | 0 | 0 | 0 | 0 | 0 | 0 | 0 | 0 | 0 | 0.1 |
| 55 | Comparative Example | 0.50 | 0 | 0 | 0 | 0 | 0 | 0 | 0 | 0 | 0 | 0.2 |
| 56 | Comparative Example | 0.50 | 0 | 0 | 0 | 0 | 0 | 0 | 0 | 0 | 0 | 0.2 |
| 57 | Example | 0.6 | 0 | 0 | 0 | 0 | 0 | 0 | 0 | 0 | 0 | 0.22 |
| 58 | Comparative Example | 0.65 | 0 | 0 | 0 | 0 | 0 | 0 | 0 | 0 | 0 | 0.13 |
| 59 | Example | 0.6 | 0 | 0 | 0 | 0 | 0 | 0 | 0 | 0 | 0 | 0.05 |
| 60 | Comparative Example | 0.4 | 0 | 0 | 0 | 0 | 0 | 0 | 0 | 0 | 0 | 0.03 |

TABLE 3B-continued

| | | Chemical composition (mass %) Remainder: Zn and impurities | | | | | | | | | | |
|---|---|---|---|---|---|---|---|---|---|---|---|---|
| | | | Element group C | | | | | | | | | |
| No. | Category | Si | Cr | Ti | Ni | Co | V | Nb | Cu | Mn | ΣC | Fe |
| 61 | Example | 0.6 | 0 | 0 | 0 | 0 | 0 | 0 | 0 | 0 | 0 | 0.0 |
| 62 | Comparative Example | 0.4 | 0 | 0 | 0 | 0 | 0 | 0 | 0 | 0 | 0 | 0.18 |
| 63 | Example | 0.6 | 0 | 0 | 0 | 0 | 0 | 0 | 0 | 0 | 0 | 0.1 |
| 64 | Comparative Example | 0.4 | 0 | 0 | 0 | 0 | 0 | 0 | 0 | 0 | 0 | 0.1 |
| 65 | Comparative Example | 0.4 | 0 | 0 | 0 | 0 | 0 | 0 | 0 | 0 | 0 | 0.03 |
| 66 | Comparative Example | 0.4 | 0 | 0 | 0 | 0 | 0 | 0 | 0 | 0 | 0 | 0.1 |
| 67 | Example | 0.52 | 0 | 0 | 0 | 0 | 0 | 0 | 0 | 0 | 0 | 0.15 |
| 68 | Example | 0.9 | 0 | 0 | 0 | 0 | 0 | 0 | 0 | 0 | 0 | 0.1 |
| 69 | Comparative Example | 1.1 | 0 | 0 | 0 | 0 | 0 | 0 | 0 | 0 | 0 | 0.1 |
| 70 | Example | 0.6 | 0 | 0 | 0 | 0 | 0 | 0 | 0 | 0 | 0 | 0.1 |
| 71 | Example | 0.03 | 0 | 0 | 0 | 0 | 0 | 0 | 0 | 0 | 0 | 0.23 |
| 72 | Example | 0.9 | 0 | 0 | 0 | 0 | 0 | 0 | 0 | 0 | 0 | 0.1 |
| 73 | Comparative Example | 1.1 | 0 | 0 | 0 | 0 | 0 | 0 | 0 | 0 | 0 | 0.1 |
| 74 | Example | 0.9 | 0 | 0 | 0 | 0 | 0 | 0 | 0 | 0 | 0 | 0.1 |
| 75 | Example | 0.6 | 0 | 0 | 0 | 0 | 0 | 0 | 0 | 0 | 0 | 0.03 |
| 76 | Example | 0.4 | 0.25 | 0 | 0 | 0 | 0 | 0 | 0 | 0 | 0.25 | 0.1 |
| 77 | Comparative Example | 0.4 | 0.30 | 0 | 0 | 0 | 0 | 0 | 0 | 0 | 0.30 | 0.15 |
| 78 | Example | 0.4 | 0 | 0.25 | 0 | 0 | 0 | 0 | 0 | 0 | 0.25 | 0.1 |
| 79 | Comparative Example | 0.4 | 0 | 0.30 | 0 | 0 | 0 | 0 | 0 | 0 | 0.30 | 0.1 |
| 80 | Example | 0.4 | 0 | 0 | 1.0 | 0 | 0 | 0 | 0 | 0 | 1.00 | 0.2 |
| 81 | Comparative Example | 0.4 | 0 | 0 | 1.1 | 0 | 0 | 0 | 0 | 0 | 1.10 | 0.04 |
| 82 | Example | 0.4 | 0 | 0 | 0 | 0.25 | 0 | 0 | 0 | 0 | 0.25 | 0.03 |
| 83 | Comparative Example | 0.4 | 0 | 0 | 0 | 0.30 | 0 | 0 | 0 | 0 | 0.30 | 0.13 |
| 84 | Example | 0.4 | 0 | 0 | 0 | 0 | 0.25 | 0 | 0 | 0 | 0.25 | 0.2 |
| 85 | Comparative Example | 0.4 | 0 | 0 | 0 | 0 | 0.30 | 0 | 0 | 0 | 0.30 | 0.13 |
| 86 | Example | 0.4 | 0 | 0 | 0 | 0 | 0 | 0.25 | 0 | 0 | 0.25 | 0.08 |
| 87 | Comparative Example | 0.4 | 0 | 0 | 0 | 0 | 0 | 0.30 | 0 | 0 | 0.30 | 0.11 |
| 88 | Example | 0.4 | 0 | 0 | 0 | 0 | 0 | 0 | 0.25 | 0 | 0.25 | 0.04 |
| 89 | Comparative Example | 0.4 | 0 | 0 | 0 | 0 | 0 | 0 | 0.30 | 0 | 0.30 | 0.05 |
| 90 | Example | 0.4 | 0 | 0 | 0 | 0 | 0 | 0 | 0 | 0.25 | 0.25 | 0.03 |
| 91 | Comparative Example | 0.4 | 0 | 0 | 0 | 0 | 0 | 0 | 0 | 0.30 | 0.30 | 0.02 |
| 92 | Example | 0.4 | 0.10 | 0.10 | 0.8 | 0 | 0 | 0 | 0 | 0 | 1.00 | 0.01 |
| 93 | Comparative Example | 0.4 | 0.25 | 0 | 0.8 | 0 | 0 | 0 | 0 | 0 | 1.05 | 0.03 |
| 94 | Example | 0.4 | 0 | 0 | 0 | 0.20 | 0.20 | 0.20 | 0.20 | 0.20 | 1.00 | 0.03 |
| 95 | Comparative Example | 0.4 | 0 | 0 | 0.1 | 0.20 | 0.20 | 0.20 | 0.20 | 0.20 | 1.10 | 0.05 |
| 96 | Example | 0.4 | 0 | 0 | 0 | 0 | 0 | 0 | 0 | 0 | 0 | 5.0 |
| 97 | Comparative Example | 0.4 | 0 | 0 | 0 | 0 | 0 | 0 | 0 | 0 | 0 | 5.2 |
| 98 | Example | 0.4 | 0 | 0 | 0 | 0 | 0 | 0 | 0 | 0 | 0 | 0.03 |
| 99 | Comparative Example | 0.4 | 0 | 0 | 0 | 0 | 0 | 0 | 0 | 0 | 0 | 0.08 |

The underlined value indicates that the value is out of the scope of the present invention.

TABLE 3C

| | | Chemical composition (mass %) Remainder: Zn and impurities | | | | | | | | | | |
|---|---|---|---|---|---|---|---|---|---|---|---|---|
| | | | Element group C | | | | | | | | | |
| No. | Category | Si | Cr | Ti | Ni | Co | V | Nb | Cu | Mn | ΣC | Fe |
| 100 | Example | 0.4 | 0 | 0 | 0 | 0 | 0 | 0 | 0 | 0 | 0 | 0.08 |
| 101 | Comparative Example | 0.4 | 0 | 0 | 0 | 0 | 0 | 0 | 0 | 0 | 0 | 0.03 |
| 102 | Example | 0.4 | 0 | 0 | 0 | 0 | 0 | 0 | 0 | 0 | 0 | 0.06 |
| 103 | Comparative Example | 0.4 | 0 | 0 | 0 | 0 | 0 | 0 | 0 | 0 | 0 | 0.05 |
| 104 | Example | 0.4 | 0 | 0 | 0 | 0 | 0 | 0 | 0 | 0 | 0 | 0.18 |
| 105 | Comparative Example | 0.4 | 0 | 0 | 0 | 0 | 0 | 0 | 0 | 0 | 0 | 0.13 |
| 106 | Example | 0.4 | 0 | 0 | 0 | 0 | 0 | 0 | 0 | 0 | 0 | 0.11 |
| 107 | Comparative Example | 0.4 | 0 | 0 | 0 | 0 | 0 | 0 | 0 | 0 | 0 | 0.08 |
| 108 | Example | 0.4 | 0 | 0 | 0 | 0 | 0 | 0 | 0 | 0 | 0 | 0.08 |
| 109 | Comparative Example | 0.4 | 0 | 0 | 0 | 0 | 0 | 0 | 0 | 0 | 0 | 0.08 |
| 110 | Example | 0.4 | 0 | 0 | 0 | 0 | 0 | 0 | 0 | 0 | 0 | 0.08 |
| 111 | Comparative Example | 0.4 | 0 | 0 | 0 | 0 | 0 | 0 | 0 | 0 | 0 | 0.08 |
| 112 | Example | 0.4 | 0 | 0 | 0 | 0 | 0 | 0 | 0 | 0 | 0 | 0.08 |
| 113 | Example | 0.4 | 0.25 | 0 | 0 | 0 | 0 | 0 | 0 | 0 | 0.25 | 4.9 |
| 114 | Example | 0.4 | 0 | 0 | 0.7 | 0 | 0 | 0 | 0 | 0 | 0.7 | 4.3 |
| 115 | Comparative Example | 0.4 | 0 | 0 | 0 | 0 | 0 | 0 | 0 | 0 | 0 | 4.6 |
| 116 | Comparative Example | 0.4 | 0 | 0 | 0 | 0 | 0 | 0 | 0 | 0 | 0 | 6.0 |
| 117 | Comparative Example | 0.4 | 0 | 0 | 0.7 | 0 | 0 | 0 | 0 | 0 | 0.7 | 4.3 |
| 118 | Comparative Example | 0.4 | 0 | 0 | 0 | 0 | 0 | 0 | 0 | 0 | 0 | 4.5 |
| 119 | Comparative Example | 0.4 | 0 | 0 | 0 | 0 | 0 | 0 | 0 | 0 | 0 | 0.1 |
| 120 | Example | 0.4 | 0 | 0 | 0 | 0 | 0 | 0 | 0 | 0 | 0 | 0.1 |
| 121 | Example | 0.4 | 0 | 0 | 0 | 0 | 0 | 0 | 0 | 0 | 0 | 0.1 |
| 122 | Comparative Example | 0.4 | 0 | 0 | 0 | 0 | 0 | 0 | 0 | 0 | 0 | 0.1 |
| 123 | Example | 0.4 | 0 | 0 | 0 | 0 | 0 | 0 | 0 | 0 | 0 | 0.1 |
| 124 | Example | 0.4 | 0 | 0 | 0 | 0 | 0 | 0 | 0 | 0 | 0 | 0.1 |
| 125 | Example | 0.4 | 0 | 0 | 0 | 0 | 0 | 0 | 0 | 0 | 0 | 0.1 |
| 126 | Example | 0.4 | 0 | 0 | 0 | 0 | 0 | 0 | 0 | 0 | 0 | 0.1 |
| 127 | Example | 0.4 | 0 | 0 | 0 | 0 | 0 | 0 | 0 | 0 | 0 | 0.1 |
| 128 | Comparative Example | 0.4 | 0 | 0 | 0 | 0 | 0 | 0 | 0 | 0 | 0 | 0.13 |
| 129 | Example | 0.4 | 0 | 0 | 0 | 0 | 0 | 0 | 0 | 0 | 0 | 0.22 |
| 130 | Comparative Example | 0.4 | 0 | 0 | 0 | 0 | 0 | 0 | 0 | 0 | 0 | 0.18 |
| 131 | Example | 0.4 | 0 | 0 | 0 | 0 | 0 | 0 | 0 | 0 | 0 | 0.13 |
| 132 | Comparative Example | 0.4 | 0 | 0 | 0 | 0 | 0 | 0 | 0 | 0 | 0 | 0.22 |
| 133 | Example | 0.4 | 0 | 0 | 0 | 0 | 0 | 0 | 0 | 0 | 0 | 0.21 |
| 134 | Example | 0.4 | 0 | 0 | 0 | 0 | 0 | 0 | 0 | 0 | 0 | 0.19 |
| 135 | Comparative Example | 0.4 | 0 | 0 | 0 | 0 | 0 | 0 | 0 | 0 | 0 | 0.18 |
| 136 | Example | 0.4 | 0 | 0 | 0 | 0 | 0 | 0 | 0 | 0 | 0 | 0.13 |
| 137 | Comparative Example | 0.1 | 0 | 0 | 0 | 0 | 0 | 0 | 0 | 0 | 0 | 0.12 |
| 138 | Example | 0.1 | 0 | 0 | 0 | 0 | 0 | 0 | 0 | 0 | 0 | 0.11 |
| 139 | Comparative Example | 0.25 | 0 | 0 | 0 | 0 | 0 | 0 | 0 | 0 | 0 | 0.08 |
| 140 | Example | 0.35 | 0 | 0 | 0 | 0 | 0 | 0 | 0 | 0 | 0 | 0.11 |

The underlined value indicates that the value is out of the scope of the present invention.

TABLE 4A

| | | Chemical composition (mass %) Remainder: Zn and impurities Element group D | | | | | | | | | | | Formula 1 | Formula 2 | Formula 3 |
|---|---|---|---|---|---|---|---|---|---|---|---|---|---|---|---|
| No. | Category | Sr | Sb | Pb | B | Li | Zr | Mo | W | Ag | P | ΣD | Si—Sn | Mg/Si | Si/Ca |
| 1 | Comparative Example | 0 | 0 | 0 | 0 | 0 | 0 | 0 | 0 | 0 | 0 | 0 | 0.52 | 17.3 | 2.6 |
| 2 | Example | 0 | 0 | 0 | 0 | 0 | 0 | 0 | 0 | 0 | 0 | 0 | 0.52 | 17.3 | 2.6 |
| 3 | Example | 0 | 0 | 0 | 0 | 0 | 0 | 0 | 0 | 0 | 0 | 0 | 0.65 | 18.7 | 3.8 |
| 4 | Example | 0 | 0 | 0 | 0 | 0 | 0 | 0 | 0 | 0 | 0 | 0 | 0.85 | 15.0 | 5.0 |
| 5 | Comparative Example | 0 | 0 | 0 | 0 | 0 | 0 | 0 | 0 | 0 | 0 | 0 | 0.85 | 15.0 | 5.0 |
| 6 | Comparative Example | 0 | 0 | 0 | 0 | 0 | 0 | 0 | 0 | 0 | 0 | 0 | 0.85 | 15.0 | 5.0 |
| 7 | Comparative Example | 0 | 0 | 0 | 0 | 0 | 0 | 0 | 0 | 0 | 0 | 0 | 0.85 | 15.0 | 5.0 |
| 8 | Comparative Example | 0 | 0 | 0 | 0 | 0 | 0 | 0 | 0 | 0 | 0 | 0 | 0.85 | 15.0 | 5.0 |
| 9 | Comparative Example | 0 | 0 | 0 | 0 | 0 | 0 | 0 | 0 | 0 | 0 | 0 | 0.85 | 15.0 | 5.0 |
| 10 | Comparative Example | 0 | 0 | 0 | 0 | 0 | 0 | 0 | 0 | 0 | 0 | 0 | 0.85 | 15.0 | 5.0 |
| 11 | Comparative Example | 0 | 0 | 0 | 0 | 0 | 0 | 0 | 0 | 0 | 0 | 0 | 0.85 | 15.0 | 5.0 |
| 12 | Example | 0 | 0 | 0 | 0 | 0 | 0 | 0 | 0 | 0 | 0 | 0 | 0.85 | 15.0 | 5.0 |
| 13 | Example | 0 | 0 | 0 | 0 | 0 | 0 | 0 | 0 | 0 | 0 | 0 | 0.85 | 15.0 | 5.0 |
| 14 | Comparative Example | 0 | 0 | 0 | 0 | 0 | 0 | 0 | 0 | 0 | 0 | 0 | 0.85 | 15.0 | 5.0 |
| 15 | Example | 0 | 0 | 0 | 0 | 0 | 0 | 0 | 0 | 0 | 0 | 0 | 0.85 | 15.0 | 5.0 |
| 16 | Example | 0 | 0 | 0 | 0 | 0 | 0 | 0 | 0 | 0 | 0 | 0 | 0.85 | 15.0 | 5.0 |
| 17 | Example | 0 | 0 | 0 | 0 | 0 | 0 | 0 | 0 | 0 | 0 | 0 | 0.85 | 15.0 | 5.0 |
| 18 | Example | 0 | 0 | 0 | 0 | 0 | 0 | 0 | 0 | 0 | 0 | 0 | 0.85 | 15.0 | 5.0 |
| 19 | Example | 0 | 0 | 0 | 0 | 0 | 0 | 0 | 0 | 0 | 0 | 0 | 0.85 | 15.0 | 5.0 |
| 20 | Example | 0 | 0 | 0 | 0 | 0 | 0 | 0 | 0 | 0 | 0 | 0 | 0 | 37.5 | 1.0 |
| 21 | Example | 0 | 0 | 0 | 0 | 0 | 0 | 0 | 0 | 0 | 0 | 0 | 0.1 | 25.0 | 1.5 |
| 22 | Example | 0 | 0 | 0 | 0 | 0 | 0 | 0 | 0 | 0 | 0 | 0 | 0.05 | 18.8 | 1.3 |
| 23 | Example | 0 | 0 | 0 | 0 | 0 | 0 | 0 | 0 | 0 | 0 | 0 | 0 | 15.0 | 1.7 |
| 24 | Example | 0 | 0 | 0 | 0 | 0 | 0 | 0 | 0 | 0 | 0 | 0 | 0.05 | 17.3 | 2.5 |
| 25 | Example | 0.3 | 0 | 0 | 0 | 0 | 0 | 0 | 0 | 0 | 0 | 0.3 | 0.4 | 18.8 | 1.0 |
| 26 | Example | 0.3 | 0 | 0 | 0 | 0 | 0 | 0 | 0 | 0 | 0 | 0.3 | 0.4 | 18.8 | 1.0 |
| 27 | Example | 0.3 | 0 | 0 | 0 | 0 | 0 | 0 | 0 | 0 | 0 | 0.3 | 0.4 | 18.8 | 1.0 |
| 28 | Comparative Example | 0.3 | 0 | 0 | 0 | 0 | 0 | 0 | 0 | 0 | 0 | 0.3 | 0.4 | 18.8 | 1.0 |
| 29 | Comparative Example | 0.3 | 0 | 0 | 0 | 0 | 0 | 0 | 0 | 0 | 0 | 0.3 | 0.4 | 18.8 | 1.0 |
| 30 | Comparative Example | 0.3 | 0 | 0 | 0 | 0 | 0 | 0 | 0 | 0 | 0 | 0.3 | 0.4 | 18.8 | 1.0 |
| 31 | Comparative Example | 0.3 | 0 | 0 | 0 | 0 | 0 | 0 | 0 | 0 | 0 | 0.3 | 0.4 | 18.8 | 1.0 |
| 32 | Comparative Example | 0.3 | 0 | 0 | 0 | 0 | 0 | 0 | 0 | 0 | 0 | 0.3 | 0.4 | 18.8 | 1.0 |
| 33 | Example | 0.3 | 0 | 0 | 0 | 0 | 0 | 0 | 0 | 0 | 0 | 0.3 | 0.4 | 18.8 | 1.0 |
| 34 | Example | 0.3 | 0 | 0 | 0 | 0 | 0 | 0 | 0 | 0 | 0 | 0.3 | 0.4 | 18.8 | 1.0 |
| 35 | Comparative Example | 0.3 | 0 | 0 | 0 | 0 | 0 | 0 | 0 | 0 | 0 | 0.3 | 0.4 | 18.8 | 1.0 |
| 36 | Example | 0.3 | 0 | 0 | 0 | 0 | 0 | 0 | 0 | 0 | 0 | 0.3 | 0.4 | 18.8 | 1.0 |
| 37 | Example | 0.3 | 0 | 0 | 0 | 0 | 0 | 0 | 0 | 0 | 0 | 0.3 | 0.4 | 18.8 | 1.0 |
| 38 | Example | 0.3 | 0 | 0 | 0 | 0 | 0 | 0 | 0 | 0 | 0 | 0.3 | 0.4 | 18.8 | 1.0 |
| 39 | Example | 0.3 | 0 | 0 | 0 | 0 | 0 | 0 | 0 | 0 | 0 | 0.3 | 0.4 | 18.8 | 1.0 |
| 40 | Example | 0.3 | 0 | 0 | 0 | 0 | 0 | 0 | 0 | 0 | 0 | 0.3 | 0.4 | 18.8 | 1.0 |
| 41 | Example | 0 | 0.3 | 0 | 0 | 0 | 0 | 0 | 0 | 0 | 0 | 0.3 | 0.4 | 18.8 | 1.0 |
| 42 | Example | 0 | 0 | 0.3 | 0 | 0 | 0 | 0 | 0 | 0 | 0 | 0.3 | 0.3 | 18.8 | 1.0 |
| 43 | Example | 0 | 0 | 0 | 0.3 | 0 | 0 | 0 | 0 | 0 | 0 | 0.3 | 1 | 15.0 | 2.0 |
| 44 | Comparative Example | 0 | 0 | 0 | 0 | 0 | 0 | 0 | 0 | 0 | 0 | 0 | 0.4 | 18.8 | 1.3 |
| 45 | Comparative Example | 0 | 0 | 0 | 0 | 0 | 0 | 0 | 0 | 0 | 0 | 0 | 0.2 | 25.0 | 1.0 |
| 46 | Example | 0 | 0 | 0 | 0 | 0.3 | 0 | 0 | 0 | 0 | 0 | 0.3 | 0.45 | 16.4 | 2.75 |
| 47 | Example | 0 | 0 | 0 | 0 | 0 | 0.3 | 0 | 0 | 0 | 0 | 0.3 | 0.6 | 15.7 | 3.5 |
| 48 | Example | 0 | 0 | 0 | 0 | 0 | 0 | 0.3 | 0 | 0 | 0 | 0.3 | 0.7 | 18.6 | 3.5 |
| 49 | Example | 0 | 0 | 0 | 0 | 0 | 0 | 0 | 0.3 | 0 | 0 | 0.3 | 0.8 | 18.8 | 4.0 |

The underlined value indicates that the value is out of the scope of the present invention.

TABLE 4B

| | | Chemical composition (mass %) Remainder: Zn and impurities | | | | | | | | | | | | | |
|---|---|---|---|---|---|---|---|---|---|---|---|---|---|---|---|
| | | Element group D | | | | | | | | | | | Formula 1 | Formula 2 | Formula 3 |
| No. | Category | Sr | Sb | Pb | B | Li | Zr | Mo | W | Ag | P | ΣD | Si—Sn | Mg/Si | Si/Ca |
| 50 | Comparative Example | 0 | 0 | 0 | 0 | 0 | 0 | 0 | 0 | 0 | 0 | 0 | 0.8 | 19.0 | 4.0 |
| 51 | Comparative Example | 0 | 0 | 0 | 0 | 0 | 0 | 0 | 0 | 0 | 0 | 0 | 0.05 | 17.5 | 4.0 |
| 52 | Comparative Example | 0 | 0 | 0 | 0 | 0 | 0 | 0 | 0 | 0 | 0 | 0 | 0.55 | 18.2 | 2.75 |
| 53 | Comparative Example | 0 | 0 | 0 | 0 | 0 | 0 | 0 | 0 | 0 | 0 | 0 | 0.55 | 18.2 | 2.75 |
| 54 | Comparative Example | 0 | 0 | 0 | 0 | 0 | 0 | 0 | 0 | 0 | 0 | 0 | 0.1 | 20.0 | 1.7 |
| 55 | Comparative Example | 0 | 0 | 0 | 0 | 0 | 0 | 0 | 0 | 0 | 0 | 0 | 0.5 | 20.0 | — |
| 56 | Comparative Example | 0 | 0 | 0 | 0 | 0 | 0 | 0 | 0 | 0 | 0 | 0 | 0.5 | 20.0 | — |
| 57 | Example | 0 | 0 | 0 | 0 | 0 | 0 | 0 | 0 | 0.3 | 0 | 0.3 | 0.5 | 20.0 | 1.0 |
| 58 | Comparative Example | 0 | 0 | 0 | 0 | 0 | 0 | 0 | 0 | 0 | 0 | 0 | 0.55 | 18.5 | 1.0 |
| 59 | Example | 0 | 0 | 0 | 0 | 0 | 0 | 0 | 0 | 0 | 0.3 | 0.3 | 0.6 | 16.7 | 2.0 |
| 60 | Comparative Example | 0 | 0 | 0 | 0 | 0 | 0 | 0 | 0 | 0 | 0 | 0 | 0.4 | 25.0 | 1.3 |
| 61 | Example | 0 | 0 | 0 | 0 | 0 | 0 | 0 | 0 | 0 | 0 | 0 | 0.6 | 16.7 | 2.0 |
| 62 | Comparative Example | 0 | 0 | 0 | 0 | 0 | 0 | 0 | 0 | 0 | 0 | 0 | 0.4 | 25.0 | 1.3 |
| 63 | Example | 0 | 0 | 0 | 0 | 0 | 0 | 0 | 0 | 0 | 0 | 0 | 0.6 | 16.7 | 2.0 |
| 64 | Comparative Example | 0 | 0 | 0 | 0 | 0 | 0 | 0 | 0 | 0 | 0 | 0 | 0.4 | 20.0 | 1.3 |
| 65 | Comparative Example | 0 | 0 | 0 | 0 | 0 | 0 | 0 | 0 | 0 | 0 | 0 | 0.4 | 20.0 | 1.0 |
| 66 | Comparative Example | 0 | 0 | 0 | 0 | 0 | 0 | 0 | 0 | 0 | 0 | 0 | 0.4 | 23.8 | 1.0 |
| 67 | Example | 0 | 0 | 0 | 0 | 0 | 0 | 0 | 0 | 0 | 0 | 0 | 0.42 | 18.3 | 1.7 |
| 68 | Example | 0 | 0 | 0 | 0 | 0 | 0 | 0 | 0 | 0 | 0 | 0 | 0.8 | 15.0 | 3.0 |
| 69 | Comparative Example | 0 | 0 | 0 | 0 | 0 | 0 | 0 | 0 | 0 | 0 | 0 | 1 | 13.6 | 3.7 |
| 70 | Example | 0 | 0 | 0 | 0 | 0 | 0 | 0 | 0 | 0 | 0 | 0 | 0.5 | 17.5 | 2.0 |
| 71 | Example | 0 | 0 | 0 | 0 | 0 | 0 | 0 | 0 | 0 | 0 | 0 | 0.03 | 168.3 | 1.0 |
| 72 | Example | 0 | 0 | 0 | 0 | 0 | 0 | 0 | 0 | 0 | 0 | 0 | 0.9 | 16.1 | 3.0 |
| 73 | Comparative Example | 0 | 0 | 0 | 0 | 0 | 0 | 0 | 0 | 0 | 0 | 0 | 1.1 | 13.2 | 3.7 |
| 74 | Example | 0 | 0 | 0 | 0 | 0 | 0 | 0 | 0 | 0 | 0 | 0 | 0.9 | 15.0 | 3.0 |
| 75 | Example | 0 | 0 | 0 | 0 | 0 | 0 | 0 | 0 | 0 | 0 | 0 | 0.52 | 16.7 | 3.0 |
| 76 | Example | 0 | 0 | 0 | 0 | 0 | 0 | 0 | 0 | 0 | 0 | 0 | 0.35 | 16.3 | 4.0 |
| 77 | Comparative Example | 0 | 0 | 0 | 0 | 0 | 0 | 0 | 0 | 0 | 0 | 0 | 0.37 | 16.3 | 1.3 |
| 78 | Example | 0 | 0 | 0 | 0 | 0 | 0 | 0 | 0 | 0 | 0 | 0 | 0.37 | 16.3 | 1.3 |
| 79 | Comparative Example | 0 | 0 | 0 | 0 | 0 | 0 | 0 | 0 | 0 | 0 | 0 | 0.37 | 16.3 | 1.3 |
| 80 | Example | 0 | 0 | 0 | 0 | 0 | 0 | 0 | 0 | 0 | 0 | 0 | 0.37 | 16.3 | 1.3 |
| 81 | Comparative Example | 0 | 0 | 0 | 0 | 0 | 0 | 0 | 0 | 0 | 0 | 0 | 0.37 | 16.3 | 1.3 |
| 82 | Example | 0 | 0 | 0 | 0 | 0 | 0 | 0 | 0 | 0 | 0 | 0 | 0.37 | 16.3 | 1.3 |
| 83 | Comparative Example | 0 | 0 | 0 | 0 | 0 | 0 | 0 | 0 | 0 | 0 | 0 | 0.37 | 16.3 | 1.3 |
| 84 | Example | 0 | 0 | 0 | 0 | 0 | 0 | 0 | 0 | 0 | 0 | 0 | 0.35 | 16.3 | 1.3 |
| 85 | Comparative Example | 0 | 0 | 0 | 0 | 0 | 0 | 0 | 0 | 0 | 0 | 0 | 0.35 | 16.3 | 1.3 |
| 86 | Example | 0 | 0 | 0 | 0 | 0 | 0 | 0 | 0 | 0 | 0 | 0 | 0.35 | 16.3 | 1.3 |
| 87 | Comparative Example | 0 | 0 | 0 | 0 | 0 | 0 | 0 | 0 | 0 | 0 | 0 | 0.35 | 16.3 | 1.3 |
| 88 | Example | 0 | 0 | 0 | 0 | 0 | 0 | 0 | 0 | 0 | 0 | 0 | 0.35 | 16.3 | 1.3 |
| 89 | Comparative Example | 0 | 0 | 0 | 0 | 0 | 0 | 0 | 0 | 0 | 0 | 0 | 0.35 | 16.3 | 1.3 |
| 90 | Example | 0 | 0 | 0 | 0 | 0 | 0 | 0 | 0 | 0 | 0 | 0 | 0.35 | 16.3 | 1.3 |
| 91 | Comparative Example | 0 | 0 | 0 | 0 | 0 | 0 | 0 | 0 | 0 | 0 | 0 | 0.35 | 16.3 | 1.3 |
| 92 | Example | 0 | 0 | 0 | 0 | 0 | 0 | 0 | 0 | 0 | 0 | 0 | 0.35 | 16.3 | 1.3 |
| 93 | Comparative Example | 0 | 0 | 0 | 0 | 0 | 0 | 0 | 0 | 0 | 0 | 0 | 0.35 | 16.3 | 1.3 |
| 94 | Example | 0 | 0 | 0 | 0 | 0 | 0 | 0 | 0 | 0 | 0 | 0 | 0.35 | 16.3 | 1.3 |
| 95 | Comparative Example | 0 | 0 | 0 | 0 | 0 | 0 | 0 | 0 | 0 | 0 | 0 | 0.35 | 16.3 | 1.3 |
| 96 | Example | 0 | 0 | 0 | 0 | 0 | 0 | 0 | 0 | 0 | 0 | 0 | 0.35 | 16.3 | 1.3 |
| 97 | Comparative Example | 0 | 0 | 0 | 0 | 0 | 0 | 0 | 0 | 0 | 0 | 0 | 0.35 | 16.3 | 1.3 |

TABLE 4B-continued

| | | Chemical composition (mass %) Remainder: Zn and impurities | | | | | | | | | | | | | |
|---|---|---|---|---|---|---|---|---|---|---|---|---|---|---|---|
| | | Element group D | | | | | | | | | | | Formula 1 | Formula 2 | Formula 3 |
| No. | Category | Sr | Sb | Pb | B | Li | Zr | Mo | W | Ag | P | ΣD | Si—Sn | Mg/Si | Si/Ca |
| 98 | Example | 0.5 | 0 | 0 | 0 | 0 | 0 | 0 | 0 | 0 | 0 | 0.5 | 0.35 | 16.3 | 1.3 |
| 99 | Comparative Example | 0.6 | 0 | 0 | 0 | 0 | 0 | 0 | 0 | 0 | 0 | 0.6 | 0.35 | 16.3 | 1.3 |

The underlined value indicates that the value is out of the scope of the present invention.

TABLE 4C

| | | Chemical composition (mass %) Remainder: Zn and impurities Element group D | | | | | | | | | | | Formula 1 | Formula 2 | Formula 3 |
|---|---|---|---|---|---|---|---|---|---|---|---|---|---|---|---|
| No. | Category | Sr | Sb | Pb | B | Li | Zr | Mo | W | Ag | P | ΣD | Si—Sn | Mg/Si | Si/Ca |
| 100 | Example | 0 | 0.5 | 0 | 0 | 0 | 0 | 0 | 0 | 0 | 0 | 0.5 | 0.35 | 16.3 | 1.3 |
| 101 | Comparative Example | 0 | 0.6 | 0 | 0 | 0 | 0 | 0 | 0 | 0 | 0 | 0.6 | 0.35 | 16.3 | 1.3 |
| 102 | Example | 0 | 0 | 0.5 | 0 | 0 | 0 | 0 | 0 | 0 | 0 | 0.5 | 0.35 | 16.3 | 1.3 |
| 103 | Comparative Example | 0 | 0 | 0.6 | 0 | 0 | 0 | 0 | 0 | 0 | 0 | 0.6 | 0.35 | 16.3 | 1.3 |
| 104 | Example | 0 | 0 | 0 | 0.5 | 0 | 0 | 0 | 0 | 0 | 0 | 0.5 | 0.35 | 16.3 | 1.3 |
| 105 | Comparative Example | 0 | 0 | 0 | 0.6 | 0 | 0 | 0 | 0 | 0 | 0 | 0.6 | 0.35 | 16.3 | 1.3 |
| 106 | Example | 0 | 0 | 0 | 0 | 0.5 | 0 | 0 | 0 | 0 | 0 | 0.5 | 0.35 | 16.3 | 1.3 |
| 107 | Comparative Example | 0 | 0 | 0 | 0 | 0.6 | 0 | 0 | 0 | 0 | 0 | 0.6 | 0.35 | 16.3 | 1.3 |
| 108 | Example | 0 | 0 | 0 | 0 | 0 | 0.5 | 0 | 0 | 0 | 0 | 0.5 | 0.35 | 16.3 | 1.3 |
| 109 | Comparative Example | 0 | 0 | 0 | 0 | 0 | 0.6 | 0 | 0 | 0 | 0 | 0.6 | 0.35 | 16.3 | 1.3 |
| 110 | Example | 0 | 0 | 0 | 0 | 0 | 0 | 0.5 | 0 | 0 | 0 | 0.5 | 0.35 | 16.3 | 1.3 |
| 111 | Comparative Example | 0 | 0 | 0 | 0 | 0 | 0 | 0.6 | 0 | 0 | 0 | 0.6 | 0.35 | 16.3 | 1.3 |
| 112 | Example | 0 | 0 | 0 | 0 | 0 | 0 | 0 | 0.5 | 0 | 0 | 0.5 | 0.35 | 16.3 | 1.3 |
| 113 | Example | 0 | 0 | 0 | 0 | 0 | 0 | 0 | 0.5 | 0 | 0 | 0.5 | 0.35 | 16.3 | 1.3 |
| 114 | Example | 0 | 0 | 0 | 0 | 0 | 0 | 0 | 0.5 | 0 | 0 | 0.5 | 0.35 | 16.3 | 1.3 |
| 115 | Comparative Example | 0 | 0 | 0 | 0 | 0 | 0 | 0 | 0.5 | 0 | 0 | 0.5 | 0.35 | 16.3 | 1.3 |
| 116 | Comparative Example | 0 | 0 | 0 | 0 | 0 | 0 | 0 | 0.5 | 0 | 0 | 0.5 | 0.35 | 16.3 | 1.3 |
| 117 | Comparative Example | 0 | 0 | 0 | 0 | 0 | 0 | 0 | 0.5 | 0 | 0 | 0.5 | 0.35 | 16.3 | 1.3 |
| 118 | Comparative Example | 0 | 0 | 0 | 0 | 0 | 0 | 0 | 0.5 | 0 | 0 | 0.5 | 0.35 | 16.3 | 1.3 |
| 119 | Comparative Example | 0 | 0 | 0 | 0 | 0 | 0 | 0 | 0.5 | 0 | 0 | 0.5 | 0.35 | 16.3 | 1.3 |
| 120 | Example | 0 | 0 | 0 | 0 | 0 | 0 | 0 | 0.5 | 0 | 0 | 0.5 | 0.35 | 16.3 | 1.3 |
| 121 | Example | 0 | 0 | 0 | 0 | 0 | 0 | 0 | 0.5 | 0 | 0 | 0.5 | 0.35 | 16.3 | 1.3 |
| 122 | Comparative Example | 0 | 0 | 0 | 0 | 0 | 0 | 0 | 0.5 | 0 | 0 | 0.5 | 0.35 | 16.3 | 1.3 |
| 123 | Example | 0 | 0 | 0 | 0 | 0 | 0 | 0 | 0.5 | 0 | 0 | 0.5 | 0.35 | 16.3 | 1.3 |
| 124 | Example | 0 | 0 | 0 | 0 | 0 | 0 | 0 | 0.5 | 0 | 0 | 0.5 | 0.35 | 16.3 | 1.3 |
| 125 | Example | 0 | 0 | 0 | 0 | 0 | 0 | 0 | 0.5 | 0 | 0 | 0.5 | 0.35 | 16.3 | 1.3 |
| 126 | Example | 0 | 0 | 0 | 0 | 0 | 0 | 0 | 0.5 | 0 | 0 | 0.5 | 0.35 | 16.3 | 1.3 |
| 127 | Example | 0 | 0 | 0 | 0 | 0 | 0 | 0 | 0.5 | 0 | 0 | 0.5 | 0.35 | 16.3 | 1.3 |
| 128 | Comparative Example | 0 | 0 | 0 | 0 | 0 | 0 | 0 | 0.6 | 0 | 0 | 0.6 | 0.35 | 16.3 | 1.3 |
| 129 | Example | 0 | 0 | 0 | 0 | 0 | 0 | 0 | 0 | 0.5 | 0 | 0.5 | 0.35 | 16.3 | 1.3 |
| 130 | Comparative Example | 0 | 0 | 0 | 0 | 0 | 0 | 0 | 0 | 0.6 | 0 | 0.6 | 0.35 | 16.3 | 1.3 |
| 131 | Example | 0 | 0 | 0 | 0 | 0 | 0 | 0 | 0 | 0 | 0.5 | 0.5 | 0.35 | 16.3 | 1.3 |
| 132 | Comparative Example | 0 | 0 | 0 | 0 | 0 | 0 | 0 | 0 | 0 | 0.6 | 0.6 | 0.35 | 16.3 | 1.3 |
| 133 | Example | 0.1 | 0.1 | 0.1 | 0.1 | 0.1 | 0 | 0 | 0 | 0 | 0 | 0.5 | 0.35 | 16.3 | 1.3 |
| 134 | Example | 0 | 0 | 0 | 0 | 0.1 | 0.1 | 0.1 | 0.1 | 0.1 | 0 | 0.5 | 0.35 | 16.3 | 1.3 |
| 135 | Comparative Example | 0.1 | 0.1 | 0.1 | 0.1 | 0.1 | 0 | 0 | 0 | 0 | 0.1 | 0.6 | 0.35 | 16.3 | 1.3 |
| 136 | Example | 0 | 0 | 0 | 0 | 0 | 0 | 0 | 0 | 0 | 0 | 0 | 0.35 | 16.3 | 1.3 |
| 137 | Comparative Example | 0 | 0 | 0 | 0 | 0 | 0 | 0 | 0 | 0 | 0 | 0 | −0.03 | 65.0 | 1.0 |

TABLE 4C-continued

| | | Chemical composition (mass %) Remainder: Zn and impurities Element group D | | | | | | | | | | | Formula 1 | Formula 2 | Formula 3 |
|---|---|---|---|---|---|---|---|---|---|---|---|---|---|---|---|
| No. | Category | Sr | Sb | Pb | B | Li | Zr | Mo | W | Ag | P | ΣD | Si—Sn | Mg/Si | Si/Ca |
| 138 | Example | 0 | 0 | 0 | 0 | 0 | 0 | 0 | 0 | 0 | 0 | 0 | 0 | 65.0 | 1.0 |
| 139 | Comparative Example | 0 | 0 | 0 | 0 | 0 | 0 | 0 | 0 | 0 | 0 | 0 | 0.2 | 26.0 | 0.8 |
| 140 | Example | 0 | 0 | 0 | 0 | 0 | 0 | 0 | 0 | 0 | 0 | 0 | 0.3 | 18.6 | 4.4 |

The underlined value indicates that the value is out of the scope of the present invention.

TABLE 5A

| | | Mathematical formula index | | | Corrosion resistance in water | |
|---|---|---|---|---|---|---|
| No. | Category | I1 | I2 | I3 | Simulated acid rain | Salt water |
| 1 | Comparative Example | 0.18 | 1.05 | 0.3 | E | E |
| 2 | Example | 0.10 | 4 | 0.02 | B | B |
| 3 | Example | 0.09 | 3 | 0.02 | B | B |
| 4 | Example | 0.07 | 7 | 0.02 | B | B |
| 5 | Comparative Example | 0.15 | 1.04 | 0.4 | E | E |
| 6 | Comparative Example | 0.19 | 1.04 | 0.3 | E | E |
| 7 | Comparative Example | 0.19 | 1.04 | 0.3 | E | E |
| 8 | Comparative Example | 0.19 | 1.01 | 0.3 | E | E |
| 9 | Comparative Example | 0.19 | 1.01 | 0.4 | E | E |
| 10 | Comparative Example | 0.19 | 1.01 | 0.3 | E | E |
| 11 | Comparative Example | 0.19 | 1.01 | 0.1 | E | E |
| 12 | Example | 0.07 | 6 | 0.01 | B | B |
| 13 | Example | 0.10 | 7 | 0.2 | C | C |
| 14 | Comparative Example | 0.18 | 1.01 | 0.2 | E | E |
| 15 | Example | 0.10 | 3 | 0.2 | C | C |
| 16 | Example | 0.05 | 7 | 0.01 | B | B |
| 17 | Example | 0.10 | 3 | 0.2 | C | C |
| 18 | Example | 0.05 | 7 | 0.01 | B | B |
| 19 | Example | 0.07 | 8 | 0.01 | B | B |
| 20 | Example | 0.09 | 1.08 | 0.03 | B | S |
| 21 | Example | 0.05 | 1.08 | 0.02 | B | S |
| 22 | Example | 0.01 | 3 | 0.03 | A | A |
| 23 | Example | 0.01 | 4 | 0.02 | A | A |
| 24 | Example | 0.01 | 5 | 0.03 | A | A |
| 25 | Example | 0.01 | 2 | 0.03 | B | A |
| 26 | Example | 0.10 | 1.05 | 0.3 | D | D |
| 27 | Example | 0.10 | 1.08 | 0.3 | D | D |
| 28 | Comparative Example | 0.15 | 1.05 | 0.3 | E | E |
| 29 | Comparative Example | 0.13 | 1.01 | 0.2 | E | E |
| 30 | Comparative Example | 0.13 | 1.01 | 0.2 | E | E |
| 31 | Comparative Example | 0.01 | 1.01 | 0.2 | E | E |
| 32 | Comparative Example | 0.10 | 1.01 | 0.2 | E | E |
| 33 | Example | 0.01 | 2 | 0.01 | C | A |
| 34 | Example | 0.10 | 2 | 0.2 | D | B |
| 35 | Comparative Example | 0.10 | 1.01 | 0.2 | E | E |
| 36 | Example | 0.10 | 2 | 0.2 | D | B |
| 37 | Example | 0.01 | 3 | 0.01 | B | A |
| 38 | Example | 0.10 | 2 | 0.2 | D | B |
| 39 | Example | 0.01 | 3 | 0.01 | B | A |
| 40 | Example | 0.01 | 2 | 0.01 | C | A |
| 41 | Example | 0.01 | 2 | 0.02 | B | A |
| 42 | Example | 0.01 | 2 | 0.02 | B | A |
| 43 | Example | 0.01 | 8 | 0.02 | A | A |

TABLE 5A-continued

| No. | Category | Mathematical formula index I1 | I2 | I3 | Corrosion resistance in water: Simulated acid rain | Salt water |
|---|---|---|---|---|---|---|
| 44 | Comparative Example | 0.11 | 1.05 | 0.2 | E | E |
| 45 | Comparative Example | 0.11 | 1.05 | 0.2 | E | E |
| 46 | Example | 0.08 | 3 | 0.02 | B | A |
| 47 | Example | 0.08 | 4 | 0.02 | B | B |
| 48 | Example | 0.08 | 4 | 0.02 | B | B |
| 49 | Example | 0.08 | 3 | 0.02 | B | B |

The underlined value indicates that the value is out of the scope of the present invention.

TABLE 5B

| No. | Category | Mathematical formula index I1 | I2 | I3 | Corrosion resistance in water: Simulated acid rain | Salt water |
|---|---|---|---|---|---|---|
| 50 | Comparative Example | 0.12 | 7 | 0.2 | E | E |
| 51 | Comparative Example | 0.12 | 1.05 | 0.2 | E | E |
| 52 | Comparative Example | 0.13 | 6 | 0.2 | E | E |
| 53 | Comparative Example | 0.13 | 1.05 | 0.2 | E | E |
| 54 | Comparative Example | 0.13 | 3 | 0.2 | E | E |
| 55 | Comparative Example | 0.13 | 1.06 | 0.2 | E | E |
| 56 | Comparative Example | 0.13 | 3 | 0.2 | E | E |
| 57 | Example | 0.08 | 3 | 0.03 | B | S |
| 58 | Comparative Example | 0.11 | 4 | 0.2 | E | E |
| 59 | Example | 0.08 | 2 | 0.03 | C | A |
| 60 | Comparative Example | 0.11 | 2 | 0.2 | E | E |
| 61 | Example | 0.08 | 2 | 0.03 | D | A |
| 62 | Comparative Example | 0.11 | 3 | 0.2 | E | E |
| 63 | Example | 0.08 | 2 | 0.03 | D | A |
| 64 | Comparative Example | 0.11 | 1.05 | 0.2 | E | E |
| 65 | Comparative Example | 0.12 | 1.06 | 0.2 | E | E |
| 66 | Comparative Example | 0.12 | 1.05 | 0.2 | E | E |
| 67 | Example | 0.08 | 7 | 0.03 | C | B |
| 68 | Example | 0.08 | 7 | 0.03 | C | B |
| 69 | Comparative Example | 0.13 | 1.05 | 0.2 | E | E |
| 70 | Example | 0.08 | 6 | 0.02 | C | B |
| 71 | Example | 0.05 | 1.05 | 0.02 | C | A |
| 72 | Example | 0.05 | 17 | 0.02 | B | B |
| 73 | Comparative Example | 0.11 | 1.05 | 0.2 | E | E |
| 74 | Example | 0.05 | 17 | 0.02 | B | B |
| 75 | Example | 0.04 | 10 | 0.03 | B | A |
| 76 | Example | 0.04 | 5 | 0.02 | A | A |
| 77 | Comparative Example | 0.11 | 1.05 | 0.2 | E | E |
| 78 | Example | 0.03 | 3 | 0.03 | A | A |
| 79 | Comparative Example | 0.11 | 3 | 0.2 | E | E |
| 80 | Example | 0.07 | 3 | 0.03 | A | A |
| 81 | Comparative Example | 0.12 | 4 | 0.2 | E | E |
| 82 | Example | 0.03 | 3 | 0.03 | A | A |
| 83 | Comparative Example | 0.13 | 1.06 | 0.2 | E | E |

TABLE 5B-continued

| No. | Category | Mathematical formula index I1 | I2 | I3 | Corrosion resistance in water: Simulated acid rain | Salt water |
|---|---|---|---|---|---|---|
| 84 | Example | 0.03 | 4 | 0.03 | A | A |
| 85 | Comparative Example | 0.11 | 2 | 0.2 | E | E |
| 86 | Example | 0.04 | 2 | 0.03 | B | A |
| 87 | Comparative Example | 0.12 | 3 | 0.2 | E | E |
| 88 | Example | 0.04 | 3 | 0.03 | A | A |
| 89 | Comparative Example | 0.13 | 1.05 | 0.2 | E | E |
| 90 | Example | 0.04 | 1.1 | 0.03 | B | B |
| 91 | Comparative Example | 0.15 | 3 | 0.2 | E | E |
| 92 | Example | 0.04 | 2.5 | 0.03 | B | B |
| 93 | Comparative Example | 0.15 | 2 | 0.2 | E | E |
| 94 | Example | 0.04 | 3 | 0.03 | A | B |
| 95 | Comparative Example | 0.11 | 1.5 | 0.2 | E | E |
| 96 | Example | 0.02 | 3 | 0.03 | B | B |
| 97 | Comparative Example | 0.12 | 1.06 | 0.2 | E | E |
| 98 | Example | 0.02 | 3 | 0.03 | A | B |
| 99 | Comparative Example | 0.12 | 3 | 0.2 | E | E |

The underlined value indicates that the value is out of the scope of the present invention.

TABLE 5C

| No. | Category | Mathematical formula index I1 | I2 | I3 | Corrosion resistance in water: Simulated acid rain | Salt water |
|---|---|---|---|---|---|---|
| 100 | Example | 0.02 | 3 | 0.03 | A | B |
| 101 | Comparative Example | 0.12 | 1.06 | 0.2 | E | E |
| 102 | Example | 0.02 | 4 | 0.03 | A | B |
| 103 | Comparative Example | 0.11 | 1.05 | 0.2 | E | E |
| 104 | Example | 0.02 | 4 | 0.02 | A | B |
| 105 | Comparative Example | 0.11 | 1.06 | 0.2 | E | E |
| 106 | Example | 0.02 | 3 | 0.02 | A | B |
| 107 | Comparative Example | 0.12 | 1.06 | 0.2 | E | E |
| 108 | Example | 0.02 | 3 | 0.02 | A | B |
| 109 | Comparative Example | 0.12 | 1.06 | 0.2 | E | E |
| 110 | Example | 0.01 | 3 | 0.02 | A | B |
| 111 | Comparative Example | 0.12 | 8 | 0.2 | E | E |
| 112 | Example | 0.02 | 3 | 0.02 | A | B |
| 113 | Example | 0.02 | 5 | 0.2 | D | D |
| 114 | Example | 0.02 | 6 | 0.2 | D | D |
| 115 | Comparative Example | 0.11 | 1.05 | 0.2 | E | E |
| 116 | Comparative Example | 0.11 | 1.01 | 0.2 | E | E |
| 117 | Comparative Example | 0.11 | 1.01 | 0.2 | E | E |
| 118 | Comparative Example | 0.11 | 1.01 | 0.2 | E | E |
| 119 | Comparative Example | 0.11 | 1.01 | 0.3 | E | E |
| 120 | Example | 0.02 | 3 | 0.01 | A | B |
| 121 | Example | 0.02 | 3 | 0.02 | A | B |
| 122 | Comparative Example | 0.11 | 1.01 | 0.3 | E | E |
| 123 | Example | 0.02 | 3 | 0.02 | A | B |
| 124 | Example | 0.02 | 4 | 0.01 | A | B |

TABLE 5C-continued

| No. | Category | Mathematical formula index I1 | I2 | I3 | Corrosion resistance in water: Simulated acid rain | Salt water |
|---|---|---|---|---|---|---|
| 125 | Example | 0.02 | 3 | 0.02 | A | B |
| 126 | Example | 0.02 | 2.5 | 0.01 | B | B |
| 127 | Example | 0.02 | 2.5 | 0.01 | B | B |
| 128 | Comparative Example | 0.11 | 1.05 | 0.3 | E | E |
| 129 | Example | 0.02 | 3 | 0.02 | A | B |
| 130 | Comparative Example | 0.11 | 1.07 | 0.3 | E | E |
| 131 | Example | 0.02 | 3 | 0.02 | A | B |
| 132 | Comparative Example | 0.11 | 1.07 | 0.3 | E | E |
| 133 | Example | 0.02 | 3 | 0.02 | A | B |
| 134 | Example | 0.02 | 4 | 0.02 | A | B |
| 135 | Comparative Example | 0.11 | 1.05 | 0.3 | E | E |
| 136 | Example | 0.02 | 2.5 | 0.02 | C | B |
| 137 | Comparative Example | 0.11 | 1.07 | 0.3 | E | E |
| 138 | Example | 0.02 | 1.3 | 0.02 | C | A |
| 139 | Comparative Example | 0.11 | 1.05 | 0.3 | E | E |
| 140 | Example | 0.04 | 4 | 0.02 | B | B |

The underlined value indicates that the value is out of the scope of the present invention.

Field of Industrial Application

The present invention can provide a hot-dip plated steel sheet capable of exhibiting high corrosion resistance in water (in simulated acid rain or salt water such as seawater) or under a constant water wetted environment in which water wetting may occur, and therefore has high industrial applicability.

The invention claimed is:

1. A hot-dip plated steel sheet comprising a plating layer on a surface of a steel sheet, wherein the plating layer has an average chemical composition including, in mass %, Al: more than 30.0% and 50.0% or less, Mg: more than 5.0% and 15.0% or less, Sn: 0% or more and 0.70% or less, Bi: 0% or more and 0.30% or less, In: 0% or more and 0.30% or less, Ca: 0.03% or more and 0.60% or less, Y: 0% or more and 0.30% or less, La: 0% or more and 0.30% or less, Ce: 0% or more and 0.30% or less, Si: more than 0.5% and 1.0% or less when Al is more than 30.0% and less than 35.0%, and 0.03% or more and 1.0% or less when Al is 35.0% or more and 50.0% or less, Cr: 0% or more and 0.25% or less, Ti: 0% or more and 0.25% or less, Ni: 0% or more and 1.0% or less, Co: 0% or more and 0.25% or less, V: 0% or more and 0.25% or less, Nb: 0% or more and 0.25% or less, Cu: 0% or more and 0.25% or less, Mn: 0% or more and 0.25% or less, Fe: 0% or more and 5.0% or less, Sr: 0% or more and 0.5% or less, Sb: 0% or more and 0.5% or less, Pb: 0% or more and 0.5% or less, B: 0% or more and 0.5% or less, Li: 0% or more and 0.5% or less, Zr: 0% or more and 0.5% or less, Mo: 0% or more and 0.5% or less, W: 0% or more and 0.5% or less, Ag: 0% or more and 0.5% or less, P: 0% or more and 0.5% or less, and a remainder containing Zn and impurities, a total amount ΣA of Sn, Bi, and In is 0% or more and 0.70% or less, a total amount ΣB of Ca, Y, La, and Ce is 0.03% or more and 0.60% or less, a total amount ΣC of Cr, Ti, Ni, Co, V, Nb, Cu, and Mn is 0% or more and 1.00% or less, a total amount ΣD of Sr, Sb, Pb, B, Li, Zr, Mo, W, Ag, and P is 0% or more and 0.5% or less, following formulas (1) to (3) are satisfied, in an X-ray diffraction pattern of a surface of the plating layer, measured under conditions in which an X-ray output is a voltage of 50 kV and a current of 300 mA using a Cu-Kα ray, when I obtained from X-ray diffraction peaks of Zn, Al, and $MgZn_2$ is defined by formula (A-1), formula (A-2) is satisfied, and when $I_2$ obtained from an X-ray diffraction peak of $Al_2O_5Si$ is defined by formula (B-1), formula (B-2) is satisfied, $$Sn \leq Si \quad (1)$$

$$15 \leq Mg/Si \quad (2)$$

$$1.0 \leq Si/Ca \leq 5.0 \quad (3)$$

[Mathematical Formula 1]

$$I_1 = \frac{I\max(36.00\sim36.60°)}{I\max(36.00\sim36.60°) + I\max(38.00\sim39.00°) + I\max(19.20\sim20.00°)} \quad (A-1)$$

$$I_1 \leqq 0.10 \quad (A-2)$$

-continued $$I_2 = \frac{I\max(15.60\sim16.60^\circ)}{I(15.60^\circ) + 0.58\{|I(15.60^\circ) - I(16.60^\circ)|\}} \quad \text{(B-1)}$$

$$1.05 \leqq I_2 \quad \text{(B-2)}$$

provided that, in formulas (1) to (3), Sn, Si, Mg, and Ca represent contents (mass %) of respective elements in the plating layer, Imax (k to m°) in formulas (A-1) and (B-1) represents an absolute maximum value of an X-ray diffraction intensity between a diffraction angle of k° and a diffraction angle of m°, Imax (n°) represents an X-ray diffraction intensity at a diffraction angle of n°, and k, m, and n each represent a diffraction angle indicated in formulas (A-1) and (B-1).

2. The hot-dip plated steel sheet according to claim 1, wherein in an X-ray diffraction pattern of a surface of the plating layer, measured under conditions in which an X-ray output is a voltage of 50 kV and a current of 300 mA using a Cu-Kα ray, when $I_3$ obtained from an X-ray diffraction peak of $MgZn_2$ is defined by formula (C-1), formula (C-2) is satisfied,

[Mathematical Formula 2]

$$I_3 = \frac{I\max(28.52\sim28.92^\circ)}{\{I\max(19.20\sim20.00^\circ) + I\max(20.58\sim20.98^\circ) + I\max(22.06\sim22.46^\circ) + I\max(28.52\sim28.92^\circ)\}} \quad \text{(C-1)}$$

$$I_3 \leqq 0.03 \quad \text{(C-2)}$$

provided that Imax (k to m°) in formula (C-1) represents an absolute maximum value of an X-ray diffraction intensity between a diffraction angle of k° and a diffraction angle of m°, and k and m each represent a diffraction angle indicated in formula (C-1).

* * * * *